United States Patent [19]

Ogawa et al.

[11] Patent Number: 4,637,972

[45] Date of Patent: Jan. 20, 1987

[54] LIGHT RECEIVING MEMBER HAVING AN AMORPHOUS SILICON PHOTOCONDUCTOR

[75] Inventors: Kyosuke Ogawa, Tokyo; Shigeru Shirai, Yamato; Keishi Saitoh, Tokyo; Teruo Misumi, Kawasaki; Junichiro Kanbe, Yokohama, all of Japan

[73] Assignee: Canon Kabushiki Kaisha, Tokyo, Japan

[21] Appl. No.: 815,123

[22] Filed: Dec. 30, 1985

Related U.S. Application Data

[63] Continuation of Ser. No. 592,802, Mar. 23, 1984, abandoned.

[30] Foreign Application Priority Data

Mar. 28, 1983 [JP] Japan ..... 58-52033
Apr. 2, 1983 [JP] Japan ..... 58-58348
Apr. 2, 1983 [JP] Japan ..... 58-58350

[51] Int. Cl.[4] ..... G03G 05/082

[52] U.S. Cl. ..... 430/84; 430/95

[58] Field of Search ..... 430/57, 84, 85, 86, 430/95

[56] References Cited

U.S. PATENT DOCUMENTS 4,460,669 7/1984 Ogawa et al. ..... 430/95
4,460,670 7/1984 Ogawa et al. ..... 430/95
4,490,454 12/1984 Misumi et al. ..... 430/84

*Primary Examiner*—John L. Goodrow
*Attorney, Agent, or Firm*—Fitzpatrick, Cella, Harper & Scinto

[57] ABSTRACT

A light-receiving member has a substrate and a light receiving layer having photoconductivity containing an amorphous material comprising a matrix of silicon atoms provided on said substrate, said light receiving layer having, from the said support side with respect to the layer thickness direction of said layer, a first layer region containing atoms of the group III of the periodic table at higher concentration toward the side of said substrate and a second layer region containing atoms of the group III of the periodic table and nitrogen atoms.

15 Claims, 45 Drawing Figures

LIGHT RECEIVING MEMBER HAVING AN AMORPHOUS SILICON PHOTOCONDUCTOR

This application is a continuation of application Ser. No. 592,802 filed Mar. 23, 1984 now abandoned.

BACKGROUND OF THE INVENTION

1. Field of the Invention

This invention relates to a light receiving member having sensitivity to electromagnetic waves such as light (herein used in a broad sense, including ultraviolet rays, visible light, infrared rays, X-rays and gamma-rays).

2. Description of the Prior Art

Photoconductive materials, which constitute image forming members for electrophotography in solid state image pick-up devices or in the field of image formation, or light receiving layers in manuscript reading devices, are required to have a high sensitivity, a high SN ratio [Photocurrent $(I_p)/(I_d)$], spectral characteristics matching to those of electromagnetic waves to be irradiated, a rapid response to light, a desired dark resistance value as well as no harm to human bodies during usage. Further, in a solid state image pick-up device, it is also required that the residual image should easily be treated within a predetermined time. Particularly, in case of an image forming member for electrophotography to be assembled in an electrophotographic device to be used in an office as office apparatus, the aforesaid harmless characteristic is very important.

From the standpoint as mentioned above, amorphous silicon (hereinafter referred to as a-Si) has recently attracted attention as a photoconductive material. For example, German OLS Nos. 2746967 and 2855718 disclose applications of a-Si for use in image forming members for electrophotography, and German OLS No. 2933411 discloses an application of a-Si for use in a photoelectricconverting reading device.

However, under the present situation, the light receiving members of the prior art having light receiving layers constituted of a-Si are further required to be improved in a balance of overall characteristics including electrical, optical and photoconductive characteristics such as dark resistance value, photosensitivity and response to light, etc., and environmental characteristics during use such as humidity resistance, and further stability with lapse of time.

For instance, when the above light receiving member is applied in an image forming member for electrophotography, residual potential is frequently observed to remain during use thereof if improvements to higher photosensitivity and higher dark resistance are scheduled to be effected at the same time. When such a light receiving member is repeatedly used for a long time, there will be caused various inconveniences such as accumulation of fatigues by repeated uses or so called ghost phenomenon wherein residual images are formed.

Further, according to a large number of experiments by the present inventors, a-Si as the material constituting the light receiving layer of an image forming member for electrophotography, while it has a number of advantages, as compared with inorganic photoconductive materials such as Se, CdS, ZnO or organic photoconductive materials such as PVCz or TNF of prior art, is also found to have problems to be solved. Namely, when charging treatment is applied for formation of electrostatic images on the light receiving layer of an image forming member for electrophotography having a light receiving member constituted of a mono-layer of a-Si which has been endowed with characteristics for use in a solar battery of prior art, dark decay is markedly rapid, whereby it is difficult to apply a conventional electrophotographic process. Moreover, this tendency is further pronounced under a humid atmosphere to such an extent in some cases that no charge is retained at all before development time.

Further, a-Si materials may contain as constituent atoms hydrogen atoms or halogen atoms such as fluorine atoms, chlorine atoms, etc. for improving their electrical, photoconductive characteristics, boron atoms, phosphorus atoms, etc. for controlling the electroconduction type as well as other atoms for improving other characteristics. Depending on the manner in which these constituent atoms are contained, there may sometimes be caused problems with respect to electrical or photoconductive characteristics of the layer formed.

Especially, at the interface between the layers adjacent to each other, depending on the contents and the distribution manner of the atoms as contained, dangling bonds are liable to be formed in manufacturing process and complicated bendings are also liable to occur in energy bands. For this reason, the problems of behaviors of the charges or stability of the structure become very important, and controlling of this part is not seldom a key for having the light receiving member exhibit its function as desired.

Also, when a-Si type light receiving member is prepared by a method generally known in the art, various problems are caused in many cases. For example, no sufficient image density can be obtained due to insufficient life of the photocarriers generated by light irradiation of the light receiving layer formed throughout said layer, or the image is liable to be unclear due to flowing of excessive photocarriers formed in the vicinity of the light receiving layer in the laterial direction. Further, there will ensue the problem due to insufficient impedance of charges injected from the support side. Accordingly, while attempting to improve the characteristics of a-Si material per se on one hand, it is also required to make efforts to obtain desired electrical and optical characteristics as mentioned above in designing of the light receiving member on the other.

SUMMARY OF THE INVENTION

In view of the above points, the present invention contemplates the achievement obtained as a result of extensive studies made comprehensively from the standpoints of applicability and utility of a-Si as a light receiving member for image forming members for electrophotography, solid stage image pick-up devices, reading devices, etc. It has now been found that a light receiving member having a layer constitution of light receiving layer comprising a light receiving layer exhibiting photoconductivity, which is constituted of so called hydrogenated amorphous silicon, or halogen-containing hydrogenated amorphous silicon which is an amorphous material containing at least one of hydrogen atom (H) and halogen atom (X) in a matrix of a-Si, especially silicon atoms [hereinafter referred to comprehensively as a-Si(H,X)], said light receiving member being prepared by designing so as to have a specific structure as hereinafter described, is found to exhibit not only practically extremely excellent characteristics but also surpass the light receiving members of the prior art in substantially all respects, especially having markedly excellent characteristics as a light receiving member for electrophotography.

An object of the present invention is to provide a light receiving member which can easily give a high quality image, which is high in density, clear in halftone and high in resolution, being free from image failure and image flow.

Another object of the present invention is to provide a light receiving member having electrical, optical and photoconductive characteristics which are constantly stable and all-environment type with virtually no dependence on the environments under use, which member is markedly excellent in light fatigue resistance and also excellent in durability without causing deterioration phenomenon when used repeatedly, exhibiting no or substantially no residual potential observed.

Still another object of the present invention is to provide a light receiving member having excellent electrophotographic characteristics, which is sufficiently capable of retaining charges at the time of charging treatment for formation of electrostatic charges to the extent such that a conventional electrophotographic method can be very effectively applied when it is provided for use as an image forming member for electrophotography.

Still another object of the present invention is to provide a light receiving member having high photosensitivity, high SN ratio characteristic and good electrical contact between the laminated layers.

According to the present invention, there is provided a light receiving member having a substrate for light receiving member and a light receiving layer having photoconductivity containing an amorphous material comprising a matrix of silicon atoms provided on said support, said light receiving layer having, from the said support side with respect to the layer thickness direction of said layer, a first layer region containing atoms of the group III of the periodic table at higher concentration toward the side of said support and a second layer region containing atoms of the group III of the periodic table and nitrogen atoms.

DETAILED DESCRIPTION OF THE PREFERRED EMBODIMENTS

Figure 1:
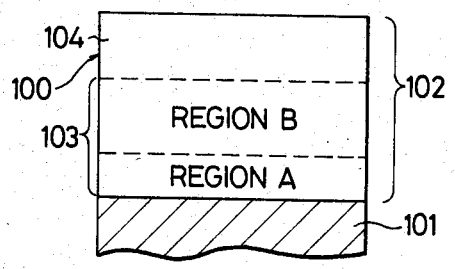
FIG. 1, FIG. 3 and FIG. 4 each show a schematic sectional view for illustration of the layer constitution of the light receiving member according to the present invention.

Referring now to the drawings, the light receiving members according to the present invention are to be described in detail below.

FIG. 1 and FIGS. 2A to 2I each show a schematic sectional view for illustration of the layer structure of a preferred embodiment of the constitution of the light receiving member of this invention.

The light receiving member 100 as shown in FIG. 1 is constituted of a light receiving layer 102 composed mainly of a-Si(H,X) having photoconductivity formed on a substrate 101 for light receiving member, said layer being divided, from the aforesaid substrate side 101, into a lower layer 103 (first layer region) and an upper layer 104 (second layer region).

The group III atoms of the periodic table contained in the light receiving layer take a depth profile which is uniform in the direction parallel to the substrate surface, but its depth profile is made ununiform with respect to the thickness direction, as shown in FIGS. 2A to 2I (the axis of ordinate indicating the distance from the substrate surface, and the axis of abscissa the depth profile as indicated by the atomic concentration of the group III atoms of the periodic table, as represented by boron atoms). The lower layer 103 is constituted, according to a preferred embodiment, of a layer region A positioned on the side of the substrate 101 containing the group III atoms of the periodic table at relatively higher concentration and a layer region B positioned on the side of the upper layer 104 containing the group III atoms at lower concentration. In each of the layer region A and the layer region B, the depth profile of the group III atoms may be either uniform or ununiform. Alternatively, in either of these regions, its concentration may be distributed so as to be decreased toward the upper layer 104.

The layer region A may have a thickness preferably of 20 Å to 20 μm, more preferably 30 Å to 15 μm, most preferably 40 Å to 10 μm. The content of the group III atoms of the periodic table within the layer region A may preferably be 30 to $5\times10^4$ atomic ppm, more preferably 50 to $5\times10^4$ atomic ppm, most preferably 100 to $5\times10^3$ atomic ppm. When the group III atoms of the periodic table contained so as to take an ununiform depth profile in the layer thickness direction within the layer region A, the maximum concentration of the group III atoms in the layer region A should preferably be 80 to $1\times10^5$ atomic ppm, more preferably 100 to $5\times10^5$ atomic ppm, most preferably 150 to $1\times10^5$ atomic ppm.

The layer region B should have a thickness preferably of 1 to 100 μm, more preferably 1 to 80 μm, most preferably 2 to 50 μm. The group III atoms of the periodic table to be contained in the layer region B is desired to take substantially uniform concentration distribution with respect to both the direction parallel to the substrate surface and the layer thickness direction. The concentration of the group III atoms contained in the layer region B should desirably be lower than the concentration of the group III atoms in the layer region A. Also, they should be contained at a concentration lower than that of said group III atoms in the upper layer 104, preferably at 0.01 to $1\times10^3$ atomic ppm, more preferably 0.5 to $3\times10^3$ atomic ppm, most preferably 1 to 100 atomic ppm.

The group III atoms of the periodic table contained in the upper layer 104 take substantially uniform concentration distribution with respect to the direction parallel to the substrate surface. The thickness of the upper layer in the layer thickness direction may preferably be 20 Å A to 15 μm, more preferably 30 Å to 10 μm, most preferably 40 Å to 5μm. The concentration of the group III atoms of the periodic table in the upper layer 104 should preferably be 0.01 to $1\times10^4$ atomic ppm, more preferably 0.5 to $5\times10^3$ atomic ppm, most preferably 1 to $1\times10^3$ atomic ppm.

Figure 2A:
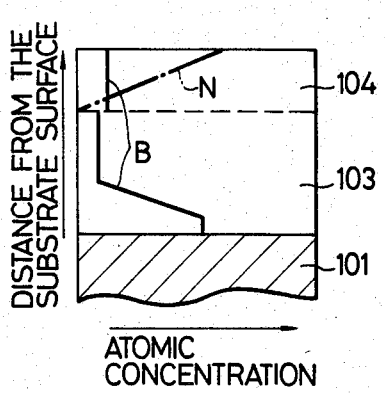
FIGS. 2A to 2I, and 5A to 5T each show a schematic illustration of the depth profiles of nitrogen atoms and atoms of the group III of the periodic table in the first layer in the light receiving member of the present invention.
Figure 2B:
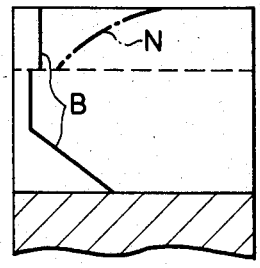
Figure 2C:
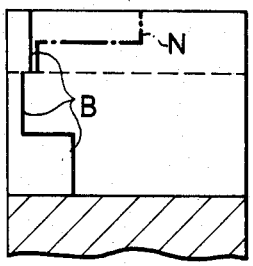
Figure 2D:
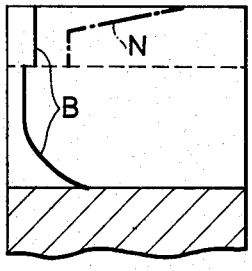
Figure 2E:
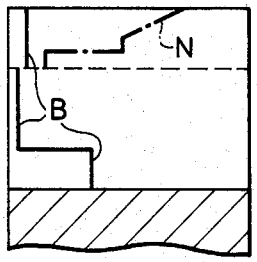
Figure 2F:
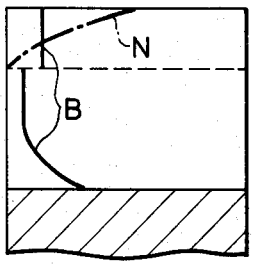
Figure 2G:
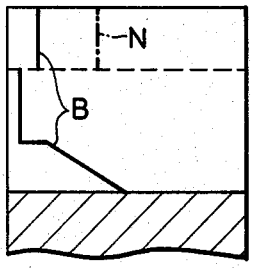
Figure 2H:
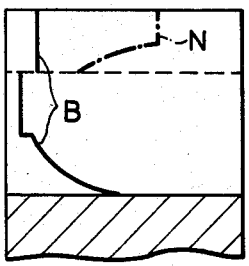
Figure 2I:
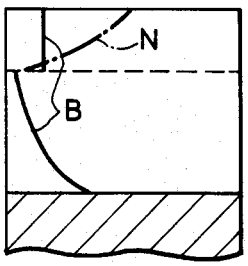

On the other hand, nitrogen atoms contained in the upper layer 104 take a substantially uniform concentration distribution with respect to the direction parallel to the substrate surface, but the depth profile with respect to the layer thickness direction may be either uniform or such that the distribution concentration may be increased toward the free surface of the light receiving layer. As to the mode of increase of the distribution concentration toward the free surface, it may be either continuous or stepwise as shown in FIGS. 2A to 2I (the concentration scale on the axis of abscissa is not the same as in the case of boron atoms). The portion near the free surface side having the maximum distribution concentration of nitrogen atoms may have a certain length in the layer thickness direction as typically shown in FIG. 2C, or alternatively it may be only one point as shown in FIG. 2A. When nitrogen atoms are contained in an ununiform distribution in the upper layer 104, the distribution concentration of nitrogen atoms in the upper layer 104 at its maximum portion, namely on the free surface side of the light receiving layer 104, should preferably be 0.1 to 57 atomic %, more preferably 1 to 57 atomic %, most preferably 5 to 57 atomic %, while at its minimum portion, namely at the bundary portion in contact with the lower layer 103 or near the boundary, preferably 0 to 35 atomic %, more preferably 0 to 30 atomic %, most preferably 0 to 25 atomic %.

The reason why the light receiving member of the present invention having a light receiving layer formed so that the concentrations of nitrogen atoms and the group III atoms of the periodic table are distributed as described above in the layer thickness direction can give a high quality visible image, which is particularly high in image density, free from image flow even under high exposure dosage on image, clear in half tone and high in resolution, when employed as an image forming member for electrophotography, may be estimated to be based on accomplishment of very good charge receiving capacity due to the effect of increased resistance of the light receiving layer by the nitrogen atoms contained and the widened gap of the energy band at the portion of the light receiving layer surface or near the surface wherein the nitrogen atom concentration is high, as well as on the effect of prevention of charge injection from the support side due to incorporation of the group III atoms at higher concentration in the layer region on the substrate side and the effect of increased resistance of the light receiving layer. More specifically, when a laminated interface exists at the upper layer portion of the light receiving layer, carriers formed excessively herein will migrate anywhere under application of an electrical field to cancel charges at the dark portion, whereby image flow appears to occur. Whereas, in the present invention, due to the widened band gap in the light receiving layer as described above, even when complicated bending may occur in the energy band at the layer interface, activation energy for carrier formation becomes greater, whereby carrier formation will not readily occur. The reason why the group III atoms of the periodic table are contained at a low concentration in the layer region B in the lower layer is because the charge receiving ability can be expected by increase of the resistance of the layer region B, whereby higher image density can be expected and further higher sensitivity can be expected by increase of the mobility of charges. The reason why the group III atoms of the periodic table are contained in the upper layer is to compensate for the increased amount of nitrogen atoms as donor with the increase in concentration of the nitrogen atoms in said layer. Further, although not confirmed, integrity of the light receiving layer may be expected by incorporation of the group III atoms throughout the whole layer, although different in concentrations added, which is also estimated to act effectively on prevention of image flow.

In the present invention, the halogen atom (X) which may be contained in the light receiving layer may include fluorine, chlorine, bromine and iodine, particularly preferably chlorine and above all fluorine.

The group III atoms of the periodic table to be contained in the light receiving layer 102 may include boron, aluminum, gallium, indium and thallium, particularly preferably boron.

The substrate to be used in the present invention may be either electroconductive or insulating. As the electroconductive material, there may be mentioned metals such as NiCr, stainless steel, Al, Cr, Mo, Au, Nb, Ta, V, Ti, Pt, Pd, etc. or alloys thereof.

As insulating substrates, there may conventionally be used films or sheets or synthetic resins, including polyester, polyethylene, polycarbonate, cellulose acetate, polypropylene, polyvinyl chloride, polyvinylidene chloride, polystyrene, polyamide, etc., glasses, ceramics, papers and so on. These insulating substrates should preferably have at least one surface subjected to electroconductive treatment, and it is desirable to provide other layers on the side at which said electroconductive treatment has been applied.

For example, electroconductive treatment of a glass can be effected by providing a thin film of NiCr, Al, Cr, Mo, Au, Ir, Nb, Ta, V, Ti, Pt, $In_2O_3$, $SnO_2$, ITO ($In_2O_3+SnO_2$) thereon. Alternatively, a synthetic resin film such as polyester film can be subjected to the electroconductive treatment on its surface by vacuum vapor deposition, electron-beam deposition or sputtering of a metal such as NiCr, Al, Ag, Pb, Zn, Ni, Au, Cr, Mo, Ir, Nb, Ta, V, Ti, Pt, etc. or by laminating treatment with said metal, thereby imparting electroconductivity to the surface.

The substrate may be shaped in any form such as cylinders, belts, plates or others, and its form may be determined as desired. For example, when the light receiving member 100 in FIG. 1 is to be used as an image forming member for electrophotography, it may desirably be formed into an endless belt or a cylinder for use in continuous high speed copying. The substrate may have a thickness, which is conveniently determined so that a light receiving member as desired may be formed. When the light receiving member is required to have a flexibility, the substrate is made as thin as possible, so far as the function of a substrate can be exhibited. However, in such a case, the thickness is preferably 10 μm or more from the points of fabrication and handling of the substrate as well as its mechanical strength.

In the present invention, formation of a light receiving layer constituted of a-Si(H,X) may be conducted according to the vacuum deposition method utilizing discharging phenomenon, such as glow discharge method, sputtering method or ion-plating method.

For example, for formation of the light receiving layer constituted of a-Si(H,X) according to the glow discharge method, the basic procedure comprises introducing a starting gas for Si supply capable of supplying silicon atoms (Si) together with a starting gas for introduction of hydrogen atoms (H) and/or halogen atoms (X) and also a starting gas for introduction of nitrogen atoms (N) and a starting gas for introduction of the group III atoms of the periodic table depending on the constituent atom composition of the layer region to be formed together with an inert gas such as Ar, He, etc., if desired, into the deposition chamber which can be internally brought to a reduced pressure, and forming a plasma atmosphere of these gases by exciting glow discharge in said deposition chamber, thereby forming a layer consisting of a-Si(H,X) on the surface of a substrate set at a predetermined position.

Alternatively, for formation according to the sputtering method, a gas for introduction of hydrogen atoms (H) and/or halogen atoms (X) and also a starting gas for introduction of nitrogen atoms (N) and a starting gas for introduction of the group III atoms of the periodic table depending on the constituent atom composition of the layer region to be formed may be introduced into the deposition chamber for sputtering when sputtering a target constituted of Si in an atmosphere of an inert gas such as Ar, He or a gas mixture based on these gases.

The starting gas for supplying Si to be used in the present invention may include gaseous or gasifiable hydrogenated silicons (silanes) such as $SiH_4$, $Si_2H_6$, $Si_3H_8$, $Si_4H_{10}$ and others as effective materials. In particular, $SiH_4$ and $Si_2H_6$ are preferred with respect to easy handling during layer formation and efficiency for supplying Si.

In the present invention, for introduction of hydrogen atoms into the light receiving layer, it is generally practiced to supply a gas primarily of $H_2$ or hydrogenated silicon such as $SiH_4$, $Si_2H_6$, $Si_3H_8$ and $Si_4H_{10}$ as mentioned above into a deposition chamber and excite discharging therein.

Effective starting gases for introduction of halogen atoms to be used in the present invention may include a large number of halogenic compounds, as exemplified preferably by halogenic gases, halides, interhalogen compounds, or gaseous or gasifiable halogenic compounds such as silane derivatives substituted with halogens. Further, there may also be included gaseous or gasifiable silicon compounds containing halogen atoms constituted of silicon atoms and halogen atoms as constituent elements as effective ones in the present invention.

Typical examples of halogen compounds preferably used in the present invention may include halogen gases such as of fluorine, chlorine, bromine or iodine, interhalogen compounds such as BrF, ClF, $ClF_3$, $BrF_5$, $BrF_3$, $IF_3$, $IF_7$, ICl, IBr, etc.

As the silicon compounds containing halogen atoms, namely so called silane derivatives substituted with halogens, there may preferably be employed silicon halides such as $SiF_4$, $Si_2F_6$, $SiCl_4$, $SiBr_4$ and the like.

As the starting gas when introducing halogen atoms into the light receiving layer, the halogen compounds or halo-containing silicon compounds as mentioned above may be used. In addition, it is also possible to use gaseous or gasifiable halides containing hydrogen atom as one of the constituents, including hydrogen halides such as HF, HCl, HBr, HI, etc., halo-substituted hydrogenated silicon such as $SiH_2F_2$, $SiH_2I_2$, $SiH_2Cl_2$, $SiHCl_3$, $SiH_2Br_2$, $SiHBr_3$, etc. as effective starting materials for formation of light receiving layer.

These halides containing hydrogen atom can introduce hydrogen atoms which are very effective components for controlling electrical and photoelectric characteristics into the layer during formation of the light receiving layer, simultaneously with introduction of halogen atoms, and therefore they can be used as preferable starting materials for introduction of halogen atoms in the present invention.

As the starting gas for supplying nitrogen atoms to be used in the present invention, there may be employed gaseous or gasifiable nitrogen, nitrogen compounds such as nitrides or azides containing N as constituent atom such as nitrogen ($N_2$), ammonia ($NH_3$), hydrazine ($H_2NNH_2$), hydrogen azide ($HN_3$), ammonium azide ($NH_4N_3$) and the like. Further, as the compounds which can introduce also halogen atoms in addition to nitrogen atoms, halogenated nitrogen compounds such as nitrogen trifluoride ($F_3N$), nitrogen tetrafluoride ($F_4N_2$) and the like are also available.

As the starting gas for supplying the group III atoms of the periodic table to be used in the present invention, there may be included $B_2H_6$, $B_4H_{10}$, $B_5H_9$, $B_5H_{11}$, $B_6H_{10}$, $GaCl_3$, $AlCl_3$, $BF_3$, $BCl_3$, $BBr_3$, $BI_3$, and the like.

For formation of the light receiving layer comprising a-Si(H,X) according to the reactive sputtering method or the ion plating method, for example, in the case of the sputtering method, a target comprising Si may be used and sputtering of this target is effected in a certain gas plasma atmosphere. Alternatively, in the case of the ion plating method, a polycrystalline silicon or single crystalline silicon is placed as the vaporizing source in a vapor deposition boat, and the vaporizing source is vaporized by heating according to the resistance heating method or the electron beam method (EB method) to be permitted to fly and pass through a certain gas plasma atmosphere.

In either of the sputtering method and the ion plating method, introduction of desired atoms into the layer formed may be effected by introducing a gas for introduction of hydrogen atoms (H) and/or halogen atoms (X) together with a starting gas for introduction of nitrogen atoms (N) and a starting gas for introduction of the group III atoms of the periodic table, containing also an inert gas such as He, Ar, etc., if desired, into the deposition chamber for sputtering or ion-plating and forming a plasma atmosphere of said gas.

For controlling the contents of hydrogen atoms, halogen atoms, nitrogen atoms or the group III atoms of the periodic table as contained in the light receiving layer 102, for example, at least one kind of the amount of the starting material to be introduced into the deposition chamber for incorporation of hydrogen atoms (H), halogen atoms (X), nitrogen atoms (N) or the group III atoms of the periodic table, the substrate temperature, discharging power, etc. may be controlled.

In the present invention, as the diluting gas to be used in formation of the light receiving layer according to the glow discharge method or the sputtering method, so called rare gases, such as He, Ne, Ar, etc. may be preferably used.

Figure 3:
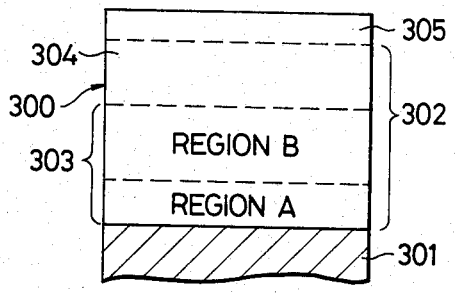

FIG. 3 is a schematic illustration of the layer constitution of a modified example of the light receiving member of the present invention as shown in FIG. 1.

The light receiving member 300 as shown in FIG. 3 has a first layer 302 having photoconductivity containing a-Si, preferably a-Si(H,X) as the main component formed on the substrate 301 for light receiving member as shown in FIG. 1 and further a second layer 305 containing silicon atoms and carbon atoms as the essential components formed on the first layer 302.

Said first layer 302 has the same layer constitution as the light receiving layer 102 shown in FIG. 1, namely having a layer constitution divided into the lower layer 303 and the upper layer 304, depending on the difference in the constituent atom composition, from the aforesaid substrate side 301 with respect to the layer thickness direction of said layer.

That is, the light receiving member 300 as shown in FIG. 3 has the same layer forming materials and the same layer constitution as the light receiving member 100 as shown in FIG. 1 except for having a second layer 305.

The second layer 305 formed on the first layer 302 in the light receiving member 300 as shown in FIG. 3 has a free surface and is provided primarily for the purpose of accomplishing the objects of the present invention with respect to humidity resistance, continuous and repeated use characteristics, dielectric strength, environmental characteristics during use and durability.

In the light receiving member shown in FIG. 3, since each of the first and the second layers has the common constituent of silicon atom, chemical stabilities are sufficiently ensured at the laminated interface.

The second layer 305 is constituted of an amorphous material comprising silicon atoms (Si), carbon atoms (C) and optionally hydrogen atoms (H) and/or halogen atoms (X) [hereinafter written as "a-$(Si_xC_{1-x})_y(H,X)_{1-y}$", where $0<x$, $y<1$].

Formation of the second layer 305 constituted of a-$(Si_xC_{1-x})_y(H,X)_{1-y}$ may be performed according to the glow discharge method, the sputtering method, the ion implantation method, the ion plating method, the electron beam method, etc. These preparation methods may be suitably selected depending on various factors such as the preparation conditions, the degree of the load for capital investment for installations, the production scale, the desirable characteristics required for the light receiving member to be prepared, etc. For the advantages of relatively easy control of the preparation conditions for preparing light receiving members having desired characteristics and easy introduction of silicon atoms and carbon atoms, optionally together with hydrogen atoms or halogen atoms, into the second layer 305 to be prepared, there may preferably be employed the glow discharge method or the sputtering method. Further, in the present invention, the second layer 305 may be formed by using the glow discharge method and the sputtering method in combination in the same device system.

For formation of the second layer 305 according to the glow discharge method, starting gases for formation of a-$(Si_xC_{1-x})_y(H,X)_{1-y}$, optionally mixed at a predetermined mixing ratio with diluting gas, may be introduced into a deposition chamber for vacuum deposition in which a substrate 301 having formed the first layer 302 having photoconductivity formed thereon is placed, and the gas introduced is made into a gas plasma by excitation of glow discharging, thereby depositing a-$(Si_xC_{1-x})_y(H,X)_{1-y}$ on the first layer 302 which has already been formed on the aforesaid substrate.

As the starting gases for formation of a-$(Si_xC_{1-x})_y(H,X)_{1-y}$ to be used in the present invention, it is possible to use most of gaseous substances or gasified gasifiable substances containing at least one of silicon atoms (Si), carbon atoms (C), hydrogen atoms (H) and halogen atoms (X) as constituent atoms.

In case when a starting gas having Si as constituent atoms as one of Si, C, H and X is employed, there may be employed, for example, a mixture of a starting gas containing Si as constituent atom, a starting gas containing C as constituent atom, and optionally a starting gas containing H as constituent atom and/or a starting gas containing X as constituent atom, if desired, at a desired mixing ratio, or alternatively a mixture of a starting gas containing Si as constituent atom with a starting gas containing C and H as constituent atoms and/or a starting gas containing C and X as constituent atoms also at a desired mixing ratio, or a mixture of a starting gas containing Si as constituent atom with a gas containing three atoms of Si, C and H or of Si, C and X as constituent atoms at a desired mixing ratio.

Alternatively, it is also possible to use a mixture of a starting gas containing Si and H or X as constituent atoms with a starting gas containing C as constituent atom.

In the present invention, preferably halogen atoms (X) to be contained in the second layer 305 are F, Cl, Br and I, particularly preferably F and Cl.

In the present invention, the compounds which can be effectively used as starting gases for formation of the second layer 305 may include hydrogenated silicon gases containing Si and H as constituent atoms such as $SiH_4$, $Si_2H_6$, $Si_3H_8$, $Si_4H_{10}$, etc.; compounds containing C and H as constituent atoms such as saturated hydrocarbons having 1 to 4 carbon atoms, ethylenic hydrocarbons having 2 to 4 carbon atoms and acetylenic hydrocarbons having 2 to 4 carbon atoms; single halogen substances; hydrogen halides; interhalogen compounds; silicon halides; and halo-substituted hydrogenated silicon.

More specifically, there may be included, as saturated hydrocarbons, methane, ethane, propane, n-butane, pentane; as ethylenic hydrocarbons, ethylene, propylene, butene-1, butene-2, isobutylene, pentene; as acetylenic hydrocarbons, acetylene, methyl acetylene, butyne; as single halogen substances, halogenic gases such as of fluorine, chlorine, bromine and iodine; as hydrogen halides, HF, HI, HCl, HBr; as interhalogen compounds, ClF, $ClF_3$, $ClF_5$, BrF, $BrF_3$, $BrF_5$, $IF_5$, $IF_7$, ICl, IBr; as silicon halides, $SiF_4$, $Si_2F_6$, $SiCl_4$, $SiCl_3Br$, $SiCl_2Br_2$, $SiClBr_3$, $SiCl_3I$, $SiBr_4$, as halo-substituted hydrogenated silicon $SiH_2F_2$, $SiH_2Cl_2$, $SiHCl_3$, $SiH_3Cl$, $SiH_3Br$, $SiH_2Br_2$, $SiHBr_3$, etc.; and so on.

In addition to these materials, there may also be employed halo-substituted paraffinic hydrocarbons such as $CF_4$, $CCl_4$, $CBr_4$, $CHF_3$, $CH_2H_2$, $CH_3F$, $CH_3Cl$, $CH_3Br$, $CH_3I$, $C_2H_5Cl$ and the like, fluorinated sulfur compounds such as $SF_4$, $SF_6$ and the like; alkyl silicides such as $Si(CH_3)_4$, $Si(C_2H_5)_4$, etc.; halo-containing alkyl silicides such as $SiCl(CH_3)_3$, $SiCl_2(CH_3)_2$, $SiCl_3CH_3$ and the like, as effective materials.

These materials for forming the second layer 305 may be selected and employed as desired during formation of the second layer 305 so that silicon atoms, carbon atoms and optionally halogen atoms and/or hydrogen atoms may be contained at a desired composition ratio in the second layer 305 to be formed.

For example, $Si(CH_3)_4$ capable of incorporating easily silicon atoms, carbon atoms and hydrogen atoms and forming a layer with desired characteristics together with a material for incorporation of halogen atoms such as $SiHCl_3$, $SiH_2Cl_2$, $SiCl_4$ or $SiH_3Cl$, may be introduced at a certain mixing ratio under gaseous state into a device for formation of the second amorphous layer, wherein glow discharging is excited thereby to form a second layer 305 comprising a-$(Si_xC_{1-x})(H,X)_{1-y}$.

For formation of the second layer 305 according to the sputtering method, a single crystalline or polycrystalline Si wafer and/or C wafer or a wafer containing Si and C mixed therein is used as target and subjected to sputtering in an atmosphere of various gases containing, if desired, halogen atoms and/or hydrogen atoms as constituent atoms.

For example, when Si wafer is used as the target, a starting gas for introducing C and H and/or X, which may be diluted with a diluting gas, if desired, is introduced into a deposition chamber for sputter to form a gas plasma therein and effect sputtering of said Si wafer.

Alternatively, Si and C as separate targets or one sheet target of a mixture of Si and C can be used and sputtering is effected in a gas atmosphere containing, if necessary, hydrogen atoms and/or halogen atoms. As the starting gas for introduction of C, H and X, there may be employed the materials for formation of the second layer 305 as mentioned in the glow discharge as described above as effective gases also in case of sputtering.

In the present invention, as the diluting gas to be used in forming the second layer 305 by the glow discharge method or the sputtering method, there may be preferably employed so called rare gases such as He, Ne, Ar and the like.

The second layer 305 should be carefully formed so that the required characteristics may be given exactly as desired.

More specifically, a substance containing as constituent atoms Si, C and, if necessary, H and/or X can take various forms from crystalline to amorphous, electrical properties from conductive through semiconductive to insulating and photoconductive properties from photoconductive to non-photoconductive depending on the preparation conditions. Therefore, in the present invention, the preparation conditions are strictly selected as desired so that there may be formed a-$(Si_xC_{1-x})_y(H,X)_{1-y}$ having desired characteristics depending on the purpose. For example, when the second layer 305 is to be provided primarily for the purpose of improvement of dielectric strength, a-$(Si_xC_{1-x})_y(H,X)_{1-y}$ is prepared as an amorphous material having marked electric insulating behaviours under the usage conditions.

Alternatively, when the primary purpose for provision of the second layer 305 is improvement of continuous repeated use characteristics or environmental use characteristics, the degree of the above electric insulating property may be alleviated to some extent and a-$(Si_xC_{1-x})_y(H,X)_{1-y}$ may be prepared as an amorphous material having sensitivity to some extent to the light irradiated.

In forming the second layer 305 comprising a-$(Si_xC_{1-x})_y(H,X)_{1-y}$ on the surface of the first layer 302, the substrate temperature during layer formation is an important factor having influences on the structure and the characteristics of the layer to be formed, and it is desired in the present invention to control severely the substrate temperature during layer formation so that a-$(Si_xC_{1-x})_y(H,X)_{1-y}$ having intended characteristics may be prepared as desired.

As the substrate temperature in forming the second layer for accomplishing effectively the objects in the present invention, there may be selected suitably the optimum temperature range in conformity with the method for forming the second layer 305 in carrying out formation of the second layer 305. Preferably, however, the substrate temperature may be 20° to 400° C, more preferably 50° to 350° C., most preferably 100° to 300° C. For formation of the second layer 305, the glow discharge method or the sputtering method may be advantageously adopted, because severe control of the composition ratio of atoms constituting the layer can be conducted with relative ease as compared with other methods. In case when the second layer 305 is to be formed according to these layer forming methods, the discharging power during layer formation is one of important factors influencing the characteristics of a-$(Si_xC_{1-x})_y(H,X)_{1-y}$ to be prepared, similarly as the aforesaid substrate temperature.

The discharging power condition for preparing effectively a-$(Si_xC_{1-x})_y(H,X)_{1-y}$ having characteristics for accomplishing the objects of the present invention with good productivity may preferably be 10 to 300 W, more preferably 20 to 250 W, most preferably 50 to 200 W.

The gas pressure in a deposition chamber may preferably be 0.01 to 1 Torr, more preferably 0.1 to 0.5 Torr.

In the present invention, the above numerical ranges may be mentioned as preferable numerical ranges for the substrate temperature, discharging power, etc. for preparation of the second layer 305. However, these factors for layer formation should not be determined separately independently of each other, but it is desirable that the optimum values of respective layer forming factors should be determined based on mutual organic relationships so that a second amorphous layer 305 comprising a-$(Si_xC_{1-x})_y(H,X)_{1-y}$ having desired characteristics may be formed. The content of carbon atoms in the second layer 305 in the light receiving member of the present invention is one of the important factors for obtaining the desired characteristics to accomplish the objects of the present invention, similarly as the conditions for preparation of the second layer 305.

The content of carbon atoms in the second layer 305 should be determined as desired depending on the characteristics of the amorphous material constituting the second layer 305.

More specifically, the amorphous material represented by the above formula a-$(Si_xC_{1-x})_y(H,X)_{1-y}$ may be classified broadly into an amorphous material constituted of silicon atoms and carbon atoms (hereinafter written as "a-$Si_aC_{1-a}$", where $0<a<1$), an amorphous material constituted of silicon atoms, carbon atoms and hydrogen atoms (hereinafter written as "a-$(Si_bC_{1-b})_cH_{1-c}$", where $0<b$, $c<1$) and an amorphous material constituted of silicon atoms, carbon atoms and halogen atoms and optionally hydrogen atoms (hereinafter written as "a-$(Si_dC_{1-d})_e(H+X)_{1-e}$", where $0<d$, $e<1$).

The content of carbon atoms contained in the second layer 305, when it is constituted of a-$Si_aC_{1-a}$, may be preferably $1\times10^{-3}$ to 90 atomic %, more preferably 1 to 80 atomic %, most preferably 10 to 75 atomic %. That is, in terms of the aforesaid representation a in the formula a-$Si_aC_{1-a}$, a may be preferably 0.1 to 0.99999, more preferably 0.2 to 0.99, most preferably 0.25 to 0.9.

On the other hand, when the second layer 305 is constituted of a-$(Si_bC_{1-b})_cH_{1-c}$, the content of carbon atoms contained in the second layer 305 may be preferably $1\times10^{-3}$ to 90 atomic %, more preferably 1 to 90 atomic %, most preferably 10 to 80 atomic %. The content of hydrogen atoms may be preferably 1 to 40 atomic %, more preferably 2 to 35 atomic %, most preferably 5 to 30 atomic %. A light receiving member formed to have a hydrogen atom content within these ranges is sufficiently applicable as an excellent one in practical applications.

That is, in terms of the representation by a-$(Si_bC_{1-b})_cH_{1-c}$, b may be preferably 0.1 to 0.99999, preferably 0.1 to 0.99, most preferably 0.15 to 0.9, and c preferably 0.6 to 0.99, preferably 0.65 to 0.98, most preferably 0.7 to 0.95.

When the second layer 305 is constituted of a-$(Si_dC_{1-d})_e(H+X)_{1-e}$, the content of carbon atoms contained in the second layer 305 may be preferably $1\times10^{-3}$ to 90 atomic %, more preferably 1 to 90 atomic %, most preferably 10 to 80 atomic %. The content of halogen atoms may be preferably 1 to 20 atomic %, more preferably 1 to 18 atomic %, most preferably 2 to 15 atomic %. A light receiving member formed to have a halogen atom content within these ranges is sufficiently applicable as an excellent one in practical applications. The content of hydrogen atoms to be optionally contained may be preferably 19 atomic % or less, more preferably 13 atomic % or less.

That is, in terms of the representation by a-$(Si_dC_{1-d})_e(H+X)_{1-e}$, d may be preferably 0.1 to 0.99999, preferably 0.1 to 0.99, most preferably 0.2 to 0.9, and e preferably 0.8 to 0.99, more preferably 0.82 to 0.99, most preferably 0.85 to 0.98.

The range of the numerical value of layer thickness of the second layer 305 should desirably be determined depending on the intended purpose so as to effectively accomplish the objects of the present invention.

The layer thickness of the second layer 305 is required to be determined as desired suitably with due considerations about the relationships with the contents of carbon atoms, the layer thickness of the first layer 302, as well as other organic relationships with the characteristics required for respective layers. In addition, it is also desirable to have considerations from economical point of view such as productivity or capability of bulk production.

The second layer 305 in the present invention is desired to have a layer thickness preferably of 0.003 to 30 μm, more preferably 0.004 to 20 μm, most preferably 0.005 to 10 μm. In the case of layer formation according to the glow discharge method, the content of carbon atoms contained in the second layer 305 can be controlled by controlling the flow rate of the gas for introduction of carbon atoms when introduced into the deposition chamber. In the case of layer formation according to the sputtering method, the sputtering area ratio of the silicon wafer to graphite wafer during formation of the target may be varied or the mixing ratio of silicon powder to graphite powder may be changed before molding into a target, whereby the content of carbon atoms can be controlled as desired. The content of the halogen atoms in the second layer 305 can be controlled by controlling the flow rate of the starting material for introduction of halogen atoms when introduced into the deposition chamber.

Figure 4:
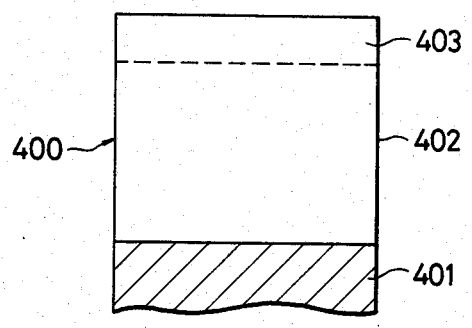

FIG. 4 shows schematically a sectional view of the layer structure of another preferred embodiment of the light receiving member of the present invention.

The light receiving member 400 of the present invention shown in FIG. 4 is constituted of a first layer 402 having photoconductivity containing as the primary component a-Si, preferably a-Si(H,X) on a substrate 401 for light receiving member and a second layer 403 containing silicon atoms and carbon atoms as essential components further formed on said first layer 402.

In the light receiving member shown in FIG. 4, the substrate 401 and the second layer 403 are the same as the substrate 301 and the second layer 305, respectively, but the first layer 402 has a layer structure different from the first layer 302 shown in FIG. 3.

Figure 5A:
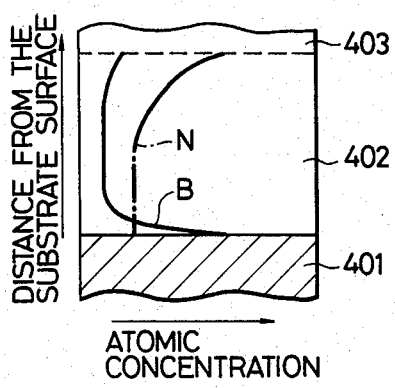
Figure 5B:
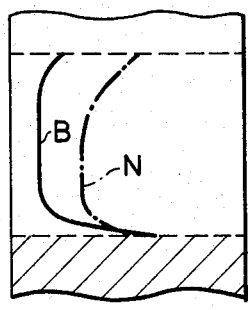
Figure 5C:
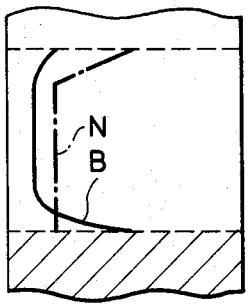
Figure 5D:
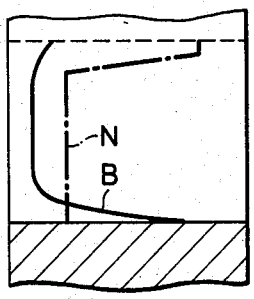
Figure 5E:
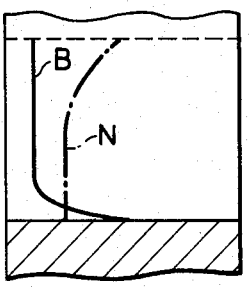
Figure 5F:
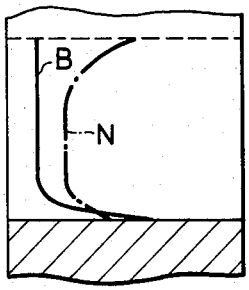
Figure 5G:
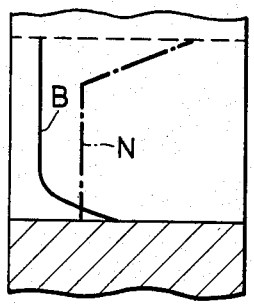
Figure 5H:
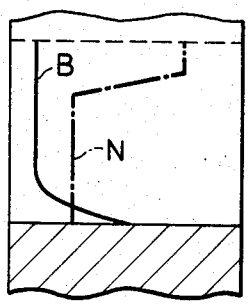
Figure 5I:
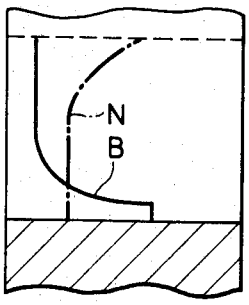
Figure 5J:
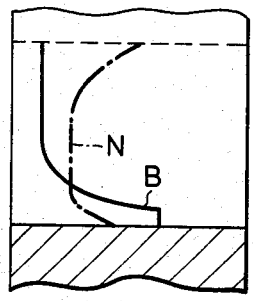
Figure 5K:
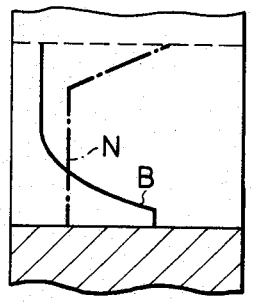
Figure 5L:
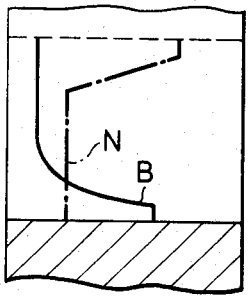
Figure 5M:
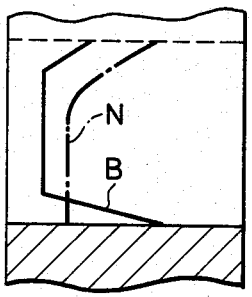
Figure 5N:
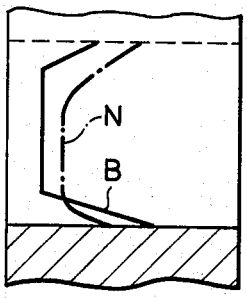
Figure 5O:
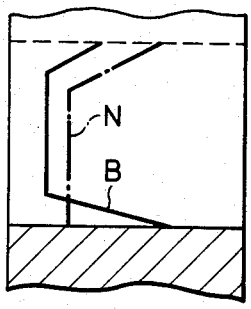
Figure 5P:
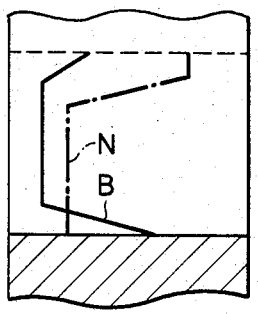
Figure 5Q:
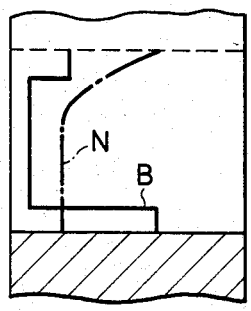
Figure 5R:
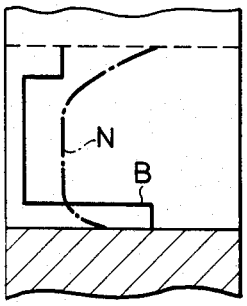
Figure 5S:
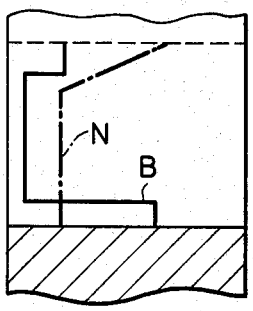
Figure 5T:
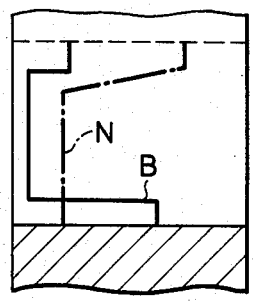

More specifically, while the depth profiles of the group III atoms of the periodic table and nitrogen atoms have the forms as shown in FIG. 2A to FIG. 2I in the case of the first layer 302 in the light receiving layer 300 shown in FIG. 3, those in the case of the first layer 402 in the light receiving member 400 have the forms as shown in FIG. 5A to FIG. 5T.

To describe in detail about this point, the nitrogen atoms contained in the first layer 402 take substantially uniform concentration distributions in the direction parallel to the substrate surface, but with respect to the thickness direction, the depth profile of nitrogen atoms is such that the distributed concentrations of nitrogen atoms are increased from the central portion of said layer 402 toward the cemented interface with the second layer 403 as shown in FIG. 5A to FIG. 5T (ordinate axis indicating the distance from the substrate surface, and abscissa axis distributed concentration). As for the depth profile of the nitrogen atoms from the central portion of said layer 402 toward the surface on the side where the substrate 401 is provided, it may have a constant concentration distribution as typically shown in FIG. 5A, or alternatively a concentration distribution such that the distributed concentrations of nitrogen atoms are increased as typically shown in FIG. 5B.

On the other hand, as for the group III atoms of the periodic table contained in said first layer 402, with respect to the direction parallel to the substrate surface 401, substantially uniform concentration distribution is taken similarly as in distribution of nitrogen atoms, but with respect to the layer thickness direction, as shown in FIG. 5A to 5T (illustrated in the Figures by boron as representative of the group III atoms, and the atomic concentration scale is not the same as in the case of nitrogen atoms), there is the greatest distributed concentration at the end surface or in the vicinity thereof on the side where the above substrate 401 is provided. The depth profile of the group III atoms of the periodic table from the central portion of said layer 402 toward the second layer 403 may preferably be such, as typically shown in FIG. 5A, that they are increased in correspondence to the increase of distributed concentration of nitrogen atoms.

Also, the portion having the maximum distributed concentration of nitrogen atoms or the greatest distributed concentration of the group III atoms in the inner portion of said layer 402 may have a certain length in the layer thickness direction as typically shown in FIG. 5D and FIG. 5I, or alternatively it may be only one point. Further, as to the mode of increase of the concentration of these atoms toward the layer end, it is more preferably continuous, but may be also changed stepwise. What kind of depth profiles of these atoms should be provided in the layer is a matter of choice which can be determined suitably depending on the balance between the functions required for the image forming member and equipments for production of the light receiving member.

The distributed concentration of nitrogen atoms contained in the first layer 402 may be preferably 0.1 to 57 atomic %, more preferably 1 to 57 atomic %, most preferably 5 to 57 atomic % at the maximum distributed concentration portion, namely in the vicinity of the layer cemented interface between said layer 402 and the second layer 403, while at the minimum distributed concentration portion, namely in the central portion or in the vicinity thereof in said layer 402, preferably 0.005 to 35 atomic %, more preferably 0.01 to 30 atomic %, most preferably 0.5 to 25 atomic %.

The above maximum and minimum distributed concentrations of nitrogen atoms may be determined suitably within the numerical ranges as specified corresponding to the distributed concentrations of the group III atoms of the periodic table, and it is desirable to increase the respective concentrations in accordance with the increase of the distributed concentration of the group III atoms of the periodic table for accomplishing more effectively the objects of the present invention. Also, the maximum distributed concentration should preferably be 1.05 times or more, more preferably 1.1 times or more, most preferably 1.15 times or more, relative to the minimum distributed concentration.

As for the content of the group III atoms of the periodic table, it may preferably be 80 to $1\times10^5$ atomic ppm, more preferably 100 to $5\times10^4$ atomic ppm, most preferably 150 to $1\times10^4$ atomic ppm at its maximum distributed concentration portion, namely at the end surface of said layer 402 on the side where the substrate 401 is provided or in the vicinity thereof, while at the minimum portion, namely at the central portion of the first layer 402, preferably 1 to 1000 atomic ppm, more preferably 5 to 700 ppm, most preferably 10 to 500 atomic ppm.

The above maximum and minimum distributed concentrations of the group III atoms of the periodic table may be determined suitably within the numerical ranges as specified corresponding to the distributed concentrations of nitrogen atoms, and it is desirable to increase the respective concentrations in accordance with the increase of the distributed concentration of nitrogen atoms for accomplishing more effectively the objects of the present invention. Also, the maximum distributed concentration should preferably be 2 times or more, more preferably 3 times or more, relative to the minimum distributed concentration.

Next, an example of the process for producing the light receiving member according to the glow discharge decomposition method is to be described.

Figure 6:
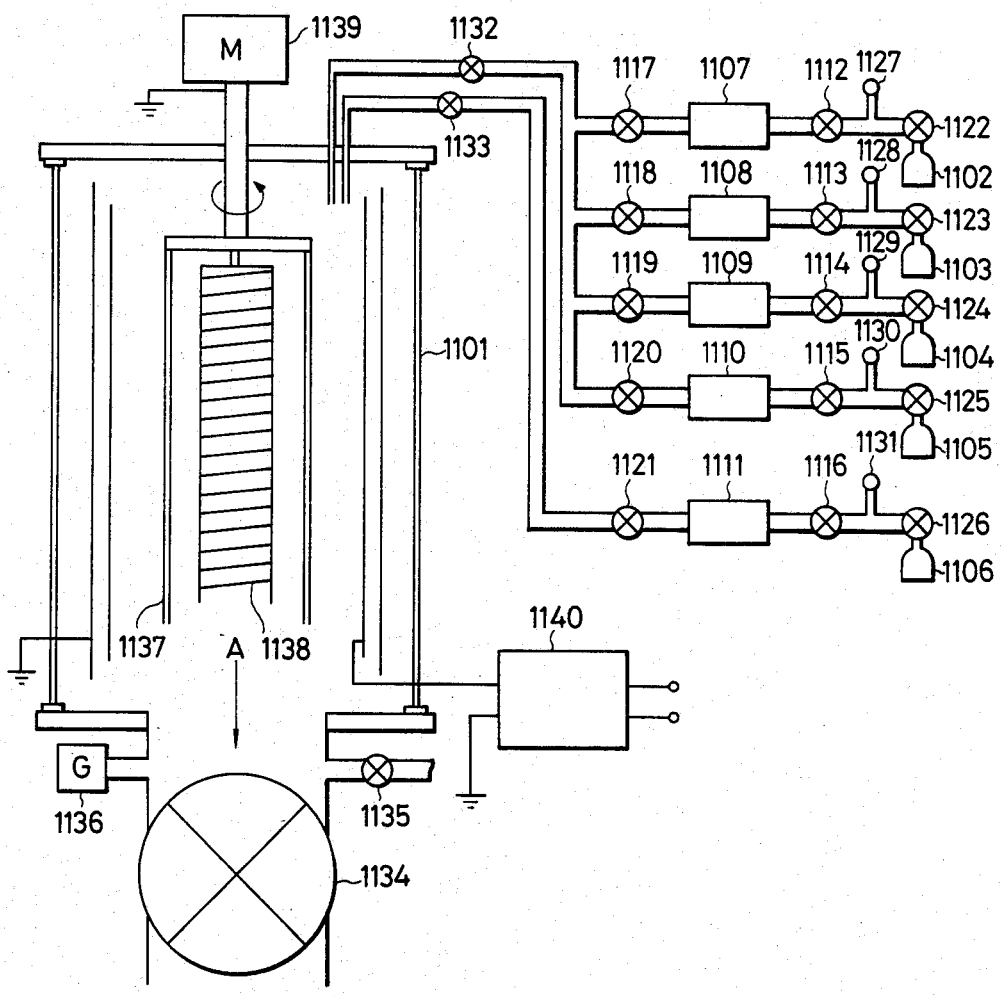
FIG. 6 shows a device for preparing the light receiving member according to the glow discharge decomposition method.

FIG. 6 shows a device for producing a photoconductive member according to the glow discharge decomposition method.

In the gas bombs 1102–1106, there are hermetically contained starting gases for formation of the light receiving layer of the light receiving member of the present invention. For example, 1102 is a bomb containing $SiH_4$ gas (purity: 99.99%), 1103 is a bomb containing $B_2H_6$ gas diluted with $H_2$ (purity: 99.99%, hereinafter abbreviated as "$B_2H_6$/He"), 1104 is a $NH_3$ gas bomb (purity: 99.99%), 1105 is a $CH_4$ gas bomb (purity: 99.99%) and 1106 is a $SiF_4$ gas bomb (purity: 99.99%). Other than these, although not shown in the drawing, it is also possible to provide additional bombs of desired gas species, if necessary.

For allowing these gases to flow into the reaction chamber 1101, on confirmation of the valves 1122–1126 of the gas bombs 1102–1106 and the leak valve 1135 to be closed, and the inflow valves 1112–1116, the outflow valves 1117–1121 and the auxiliary valves 1132 and 1133 to be opened, the main valve 1134 is first opened to evacuate the reaction chamber 1101 and the gas pipelines. As the next step, when the reading on the vacuum indicator 1136 becomes $5\times10^{-6}$ Torr, the auxiliary valves 1132 and 1133 and the outflow valves 1117–1121 are closed. Then, $SiH_4$ gas from the gas bomb 1102, $B_2H_6/H_2$ gas from the gas bomb 1103, $NH_3$ gas from the gas bomb 1104, $CH_4$ gas from the gas bomb 1105 and $SiF_4$ gas from the gas bomb 1106 are permitted to flow into the mass-flow controllers 1107–1111, respectively, by controlling the pressures at the outlet pressure gauges 1127–1131 to 1 Kg/cm$^2$, respectively, by opening the valves 1122–1126 and opening gradually inflow valves 1112–1116. Subsequently, the outflow valves 1117–1121 and the auxiliary valves 1132 and 1133 are gradually opened to permit respective gases to flow into the reaction chamber 1101. The outflow valves 1117–1121 are controlled so that the flow rate ratio of the respective gases may have a desired value and opening of the main valve 1134 is also controlled while watching the reading on the vacuum indicator 1136 so that the pressure in the reaction chamber may reach a desired value. And, after confirming that the temperature of the substrate cylinder 1137 is set at 50°–400° C. by the heater 1138, the power source 1140 is set at a desired power to excite glow discharge in the reaction chamber 1101.

At the same time, $B_2H_6/H_2$ gas flow rate is suitably changed so that the boron atom content curve previously designed may be obtained, and discharging power and the substrate temperature may be controlled, if desired, in the sense to compensate for the plasma conditions changed corresponding to the change in said gas flow rate, to form a layer region A constituting the lower layer of the first layer.

During the layer formation, in order to effect uniformization of layer formation, the substrate cylinder 1137 is rotated at a constant speed by means of a motor 1139.

As the next step, all the gas operating system valves are closed, and the reaction chamber 1101 is once evacuated to a high vacuum. When the reading on the vacuum indicator 1136 becomes $5\times10^{-6}$ Torr, the same operations as in the above case are repeated. That is, the operational system valves of $SiH_4$, $SiF_4$ and $B_2H_6/H_2$ are opened to control the flow rates of respective gases to desired values, followed by excitation of glow discharge as described above, thus forming a region B constituting the lower layer of the first layer.

Also, as for the upper layer constituting the first layer, by repeating the same operations as described above, there can be formed a layer having the content distribution curves for nitrogen atoms and boron atoms previously designed. Thus, a light receiving member having the layer constitution as shown in FIG. 1 is formed.

For formation of a light receiving member with a layer constitution as shown in FIG. 3, layer formation as described below may be further conducted. That is, subsequent to the layer preperation process as described above, all the gas operational system valves employed are closed and the reaction chamber 1101 is once evacuated to a high vacuum. When the reading on the vacuum indicator becomes $5\times10^{-6}$ Torr, the same operations as in the above case are repeated. That is, the operational system valves of $SiH_4$, $CH_4$ and optionally a diluting gas such as He are opened to control the flow rates of respective cases to desired values, followed by excitation of glow discharge similarly as described in the case of the first layer, thus forming a second layer. When halogen atoms are contained in the second layer, the operational system valve of $SiF_4$ is opened at the same time, followed by excitation of glow discharge. Thus, a light receiving member as shown in FIG. 3 is prepared.

The following Examples are set forth for further illustration of the present invention.

EXAMPLE 1

Figure 7:
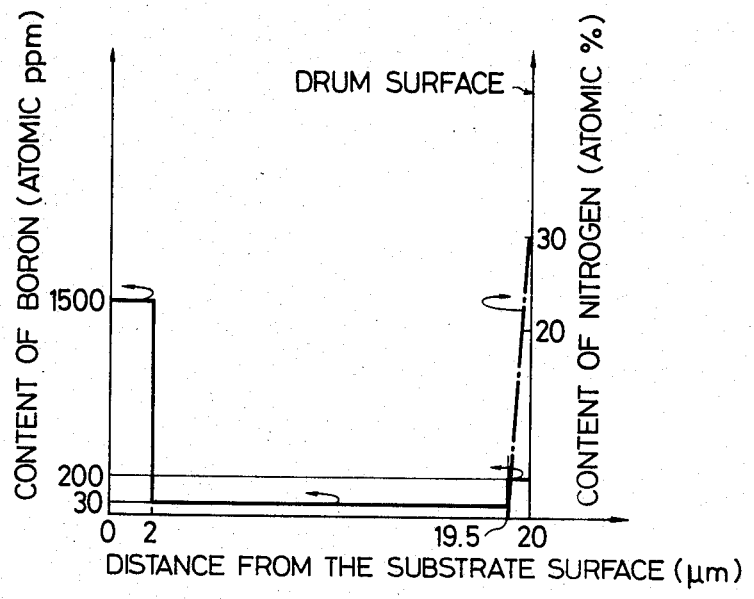
FIGS. 7 to 18 each is a chart showing the analytical result of the depth profile of the constituent atoms in the light receiving layer in Examples of the present invention.

By means of the device for the preparation of photoconductive members as shown in FIG. 6, a light receiving layer was formed on a cylinder made of aluminum according to the glow discharge decomposition method as previously described under the preparation conditions as shown in Table 1. A part of the drum-shaped light receiving member was cut, and quantitative determinations of the concentrations of boron atoms and nitrogen atoms in the direction of layer thickness were practiced by use of a secondary ion mass analyzer to obtain the results of the depth profiles as shown in FIG. 7. Also, the residual part of the light receiving member drum was set in an electrophotographic device, and the latent image was formed under a charging corona voltage of ⊕6 KV and an image exposure of 0.8–1.5 lux.sec, followed subsequently by respective processes of developing, transfer and fixing according to known methods, and the image obtained was evaluated. Image evaluation was performed by practicing image formation corresponding in total number to 100,000 sheets with use of A4 size papers under normal environment and further practicing image formation corresponding to 100,000 sheets under high temperature and high humidity environment, and every sample per 10,000 sheets was evaluated for its superiority or inferiority in terms of density, resolution, gradation reproducibility, image defect, etc. As the result, not depending on the environmental conditions and the number of sheets of successive copying, very good evaluations could be obtained for all of the items as mentioned above. In particular, marked results were obtained in the item of density and it was confirmed that images with very high density could be obtained. This is also supported by the results of measurement of potentials. For example, as compared with a sample having no treatment applied on the surface of the light receiving layer, the receiving potential was found to be improved about 1.4 to 1.7 times. This may be estimated to be due to successful development of the effect of impeding injection of charges from the surface by doping of nitrogen atoms and the minute amount doping effect of boron atoms. Improvement of charge receiving ability afforded not only increased image density but also a latitude with wide corona conditions, thus having a great advantage of enlarged scope in choice of image quality.

As still another marked item, resolution may be mentioned and in a series of tests at the present time, very clear images were found to be maintained under any environmental conditions. This seems to be due to the effect of the upper layer of the light receiving member having the nitrogen atom depth profile as shown in FIG. 7, and distinct difference in resolution appeared under the highly humid conditions as compared with a member having no such depth profile in the upper layer.

EXAMPLES 2, 3 AND COMPARATIVE EXAMPLES 1, 2

Drum-shaped light receiving members were prepared according to the same procedure as in Example 1 except that the layer thickness of the third layer (upper layer) was changed variously by changing the deposition time. Image evaluations were practiced for these light receiving members similarly as in Example 1 to obtain the results as shown in Table 2.

EXAMPLES 4, 5 AND COMPARATIVE EXAMPLES 3, 4

Drum-shaped light receiving members were prepared according to the same procedure and under the same conditions as in Example 3 except that the flow rate of ammonia gas was changed variously in formation of the third layer (upper layer). Image evaluations were practiced for these light receiving members similarly as in Example 1 to obtain the results as shown in Table 3.

EXAMPLES 6 AND 7

Figure 8:
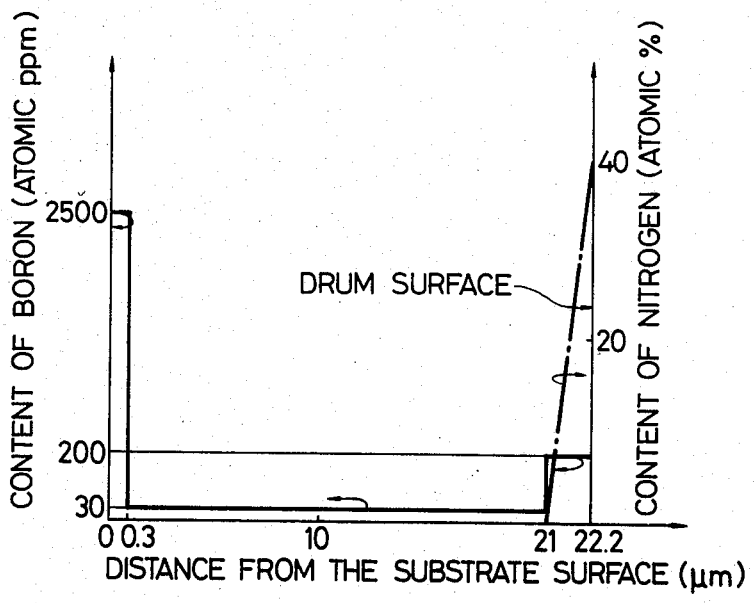
Figure 9:
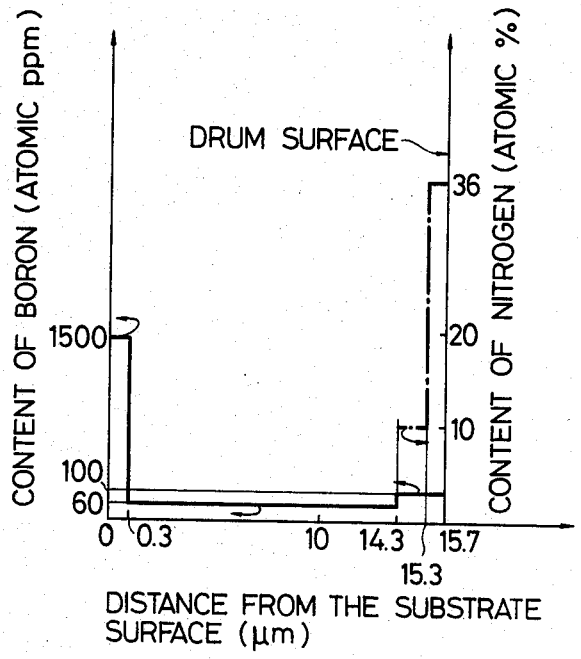

Drum-shaped light receiving members were prepared according to the same procedure as in Example 1, following the preparation conditions as shown in Tables 4 and 5. The forms of depth profiles of nitrogen atoms and boron atoms in the light receiving members obtained were as shown in FIG. 8 and FIG. 9. As the result of image evaluations conducted similarly as in Example 1, good results substantially equal to Example 1 could be obtained.

EXAMPLE 8

Figure 10:
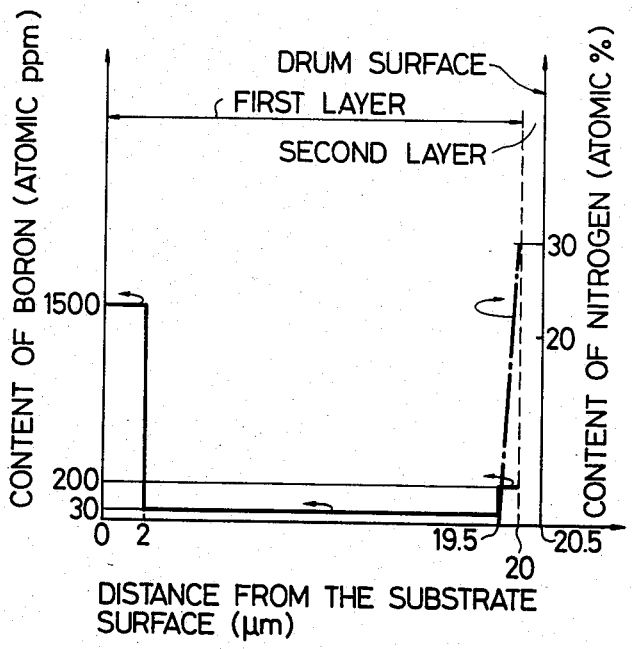

By means of the device for preparation of light receiving member as shown in FIG. 6, a light receiving layer was formed on a cylinder made of aluminum according to the glow discharge decomposition method as previously described under the preparation conditions as shown in Table 6. A part of the drum-shaped light receiving member was cut, and quantitative determinations of the concentrations of boron atoms and nitrogen atoms in the direction of layer thickness were practiced by use of a secondary ion mass analyzer to obtain the results of the depth profiles as shown in FIG. 10. Also, the residual part of the light receiving member drum was set in an electrophotographic device, and the latent image was formed under a charging corona voltage of ⊖6 KV and an image exposure of 0.8–1.5 lux.sec, followed subsequently by respective processes of developing, transfer and fixing according to known methods, and the image obtained was evaluated. Image evaluation was performed by practicing image formation corresponding in total number to 100,000 sheets with use of A4 size papers under normal environment and further practicing image formation corresponding to 100,000 sheets under high temperature and high humidity environment, and every sample per 10,000 sheets was evaluated for its superiority or inferiority in terms of density, resolution, gradation reproducibility, image defect, etc. As the result, not depending on the environmental conditions and the number of sheets of successive copying, very good evaluations could be obtained for all of the items as mentioned above. In particular, marked results were obtained in the item of density and it was confirmed that images with very high density could be obtained. This is also supported by the results of measurement of potentials. For example, as compared with a sample having no treatment applied on the surface of the light receiving layer, the receiving potential was found to be improved about 1.4 to 1.7 times. This may be estimated to be due to successful development of the effect of impeding injection of charges from the surface by doping of nitrogen atoms and the minute amount doping effect of boron atoms. Improvement of charge receiving ability afforded not only increased image density but also a latitude with wide corona conditions, thus having a great advantage of enlarged scope in choice of image quality.

As still another marked item, resolution may be mentioned and in a series of tests at the present time, very clear images were found to be maintained under any environmental conditions. This seems to be due to the effect of the upper layer of the first layer having the nitrogen atom depth profile as shown in FIG. 10, and distinct difference in resolution appeared under the highly humid conditions as compared with a member having no such depth profile in the upper layer.

EXAMPLES 9, 10 AND COMPARATIVE EXAMPLES 6, 7

Drum-shaped light receiving members were prepared according to the same procedure as in Example 8 except that the layer thickness of the third layer (upper layer) was changed variously by changing the deposition time. Image evaluations were practiced for these light receiving members similarly as in Example 8 to obtain the results as shown in Table 7.

EXAMPLES 11, 12 AND COMPARATIVE EXAMPLES 8–10

Drum-shaped light receiving members were prepared according to the same procedure and under the same conditions as in Example 10 except that the flow rate of ammonia gas was changed variously in formation of the third layer (upper layer). Image evaluations were practiced for these light receiving members similarly as in Example 8 to obtain the results as shown in Table 8.

EXAMPLES 13 AND 14

Figure 11:
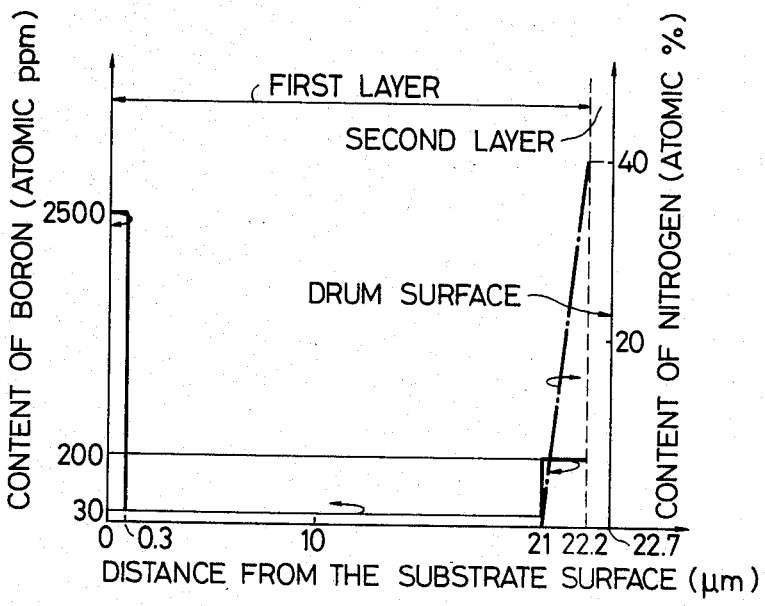
Figure 12:
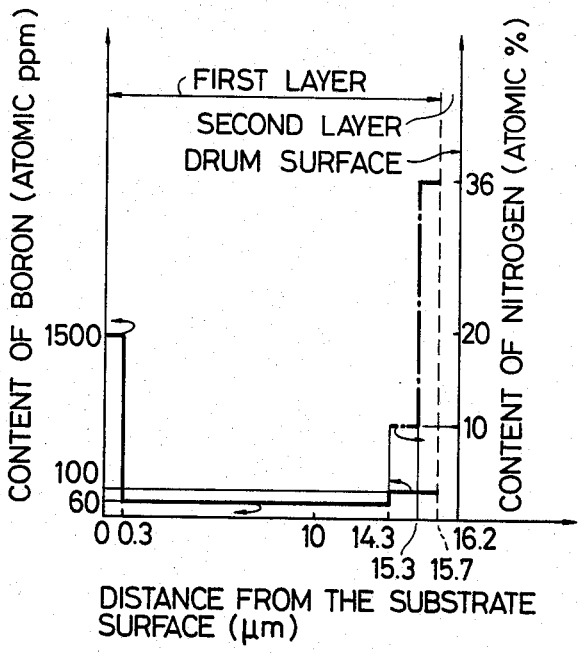

Drum-shaped light receiving members were prepared according to the same procedure as in Example 8, following the preparation conditions as shown in Tables 9 and 10. The forms of depth profiles of nitrogen atoms and boron atoms in the light receiving members obtained were as shown in FIG. 10 and FIG. 11, respectively. As the result of image evaluations conducted similarly as in Example 8, good results substantially equal to Example 8 could be obtained.

EXAMPLE 15

On the light receiving members, of which first layers were formed following the same conditions and the procedures as described in Examples 8, 13 and 14, second layers were formed according to the sputtering method as described in detail in Japanese Laid-open Patent Publication Nos. 52178/1982 and 52179/1982 under the conditions as indicated in Table 11-1, respectively, to prepare 9 kinds of samples, and also 15 kinds of samples were prepared by forming second layers according to the same glow discharge method as described in Example 8 except for changing the respective conditions as indicated in Table 11-2 on the same drum-shaped light receiving members as mentioned above (24 samples as total of 8-1-1 to 8-1-8, 8-6-1 to 8-6-8 and 8-71 to 8-7-8).

Each of the image forming members for electrophotography was set individually in a copying device, subjected to corona charging at ⊕5.0 KV for 0.2 sec., followed by irradiation of a light image. As the light source, a tungsten lamp was used as a dosage of 1.0 lux.sec. The latent image was developed with a positively charged developer (containing toner and carrier) and transferred onto conventional paper. The transferred image was very good. The toner remaining on the image forming member for electrophotography was cleaned with a rubber blade. Even when such steps were repeated 100,000 times or more, no image deterioration was observed in any case.

The results of overall image evaluation of the transferred image and evaluation of durability by successive continuous usage are given in Table 12.

EXAMPLE 16

Image forming members were formed according to entirely the same procedure as in Example 8, except that during formation of the second layer according to the sputtering method, the ratio of silicon atoms to carbon atoms in the second layer was changed by varying the target area ratio of silicon wafer to graphite. For each of the image members thus formed, the same steps of image formation, developing and cleaning as in Example 8 were repeated for 100,000 times, and thereafter image evaluation was conducted to obtain the results as shown in Table 13.

EXAMPLE 17

Image forming members were formed according to entirely the same procedure as in Example 8, except that during formation of the second layer, the ratio of silicon atoms to carbon atoms in the second layer was changed by varying the flow rate ratio of $SiH_4$ gas to $C_2H_4$ gas. For each of the image members thus formed, the same steps of image formation, developing and cleaning as in Example 8 were repeated for 100,000 times, and thereafter image evaluation was conducted to obtain the results as shown in Table 14.

EXAMPLE 18

Image forming members were formed according to entirely the same procedure as in Example 8, except that during formation of the second layer, the ratio of silicon atoms to carbon atoms in the second layer was changed by varying the flow rate ratio of $SiH_4$ gas, $SiF_4$ gas and $C_2H_4$ gas. For each of the image members thus formed, the same steps of image formation, developing and cleaning as in Example 8 were repeated for 100,000 times, and thereafter image evaluation was conducted to obtain the results as shown in Table 15.

EXAMPLE 19

Figure 13:
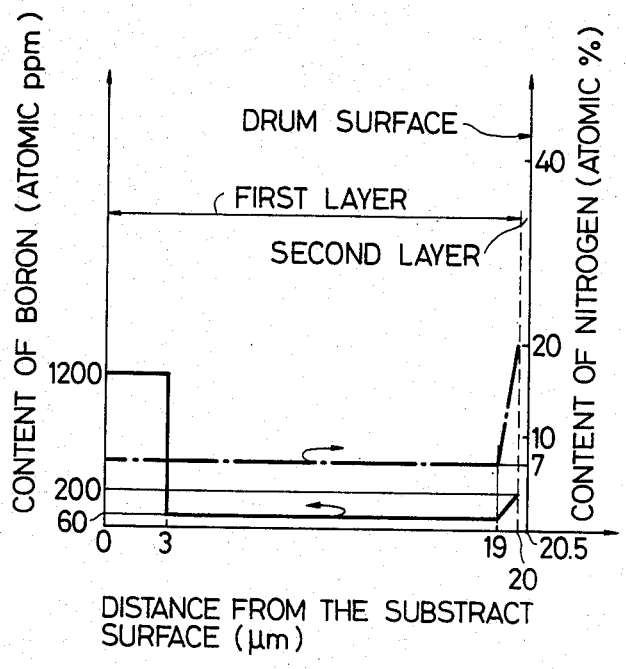

By means of the device for preparation of light receiving member as shown in FIG. 6, a first layer and a second layer having photoconductivity were formed on a cylinder made of aluminum according to the glow discharge decomposition method as previously described under the preparation conditions as shown in Table 16. A part of the drum-shaped light receiving member was cut, and quantitative determinations of the concentrations of boron atoms and nitrogen atoms in the direction of layer thickness were practiced by use of a secondary ion mass analyzer to obtain the results of the depth profiles as shown in FIG. 13. Also, the residual part of the light receiving member drum was set in an electrophotographic device, and the latent image was formed under a charging corona voltage of ⊖6 KV and an image exposure of 0.8–1.5 lux.sec, followed subsequently by respective processes of developing, transfer and fixing according to known methods, and the image obtained was evaluated. Image evaluation was performed by practicing image formation corresponding in total number to 150,000 sheets with use of A4 size papers under normal environment and further practicing image formation corresponding to 150,000 sheets under high temperature and high humidity environment, and every sample per 10,000 sheets was evaluated for its superiority or inferiority in terms of density, resolution, gradation reproducibility, image defect, etc. As the result, not depending on the environmental conditions and the number of sheets of successive copying, very good evaluations could be obtained for all of the items as mentioned above. In particular, marked results were obtained in the item of density and it was confirmed that images with very high density could be obtained. This is also supported by the results of measurement of potentials. For example, as compared with a sample having no treatment applied on the surface of the light receiving layer, the receiving potential was found to be improved about 2 to 2.5 times. This seems to be due to a sufficient effect of the enhanced electric resistance caused by doping the first layer with nitrogen atoms and the prevention of charge injection caused by changing the content of boron atoms. Improvement of charge receiving ability afforded not only increased image density but also a latitude with wide corona conditions, thus having a great advantage of enlarged scope in choice of image quality.

As still another marked item, resolution may be mentioned and in a series of tests at the present time, very clear images were found to be maintained under any environmental conditions. This seems to be due to the effect of the nitrogen atom depth profile having the maximum portion in the vicinity of the cemented interface between the first layer and the second layer as shown in FIG. 13, and the resolution is distinctly different from that of a member having no such depth profile.

EXAMPLE 20

Figure 14:
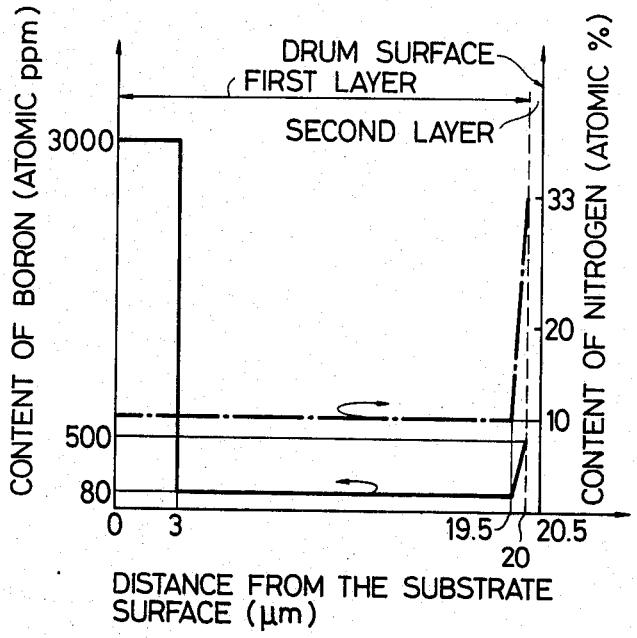

Drum-shaped light receiving members were prepared according to the same procedure as in Example 19 except that the forms of the depth profiles of nitrogen atoms and boron atoms were changed. The details of preparation conditions are shown in Table 16. Analyses of the constituent atom concentrations and image evaluations were practiced for these drum-shaped light receiving members similarly as in Example 19. As the result the depth profiles of nitrogen atoms and boron atoms as shown in FIG. 14 were obtained. As to image evaluation, good results substantially equal to Example 19 were obtained.

COMPARATIVE EXAMPLE 11 AND EXAMPLES 21–23

Figure 15:
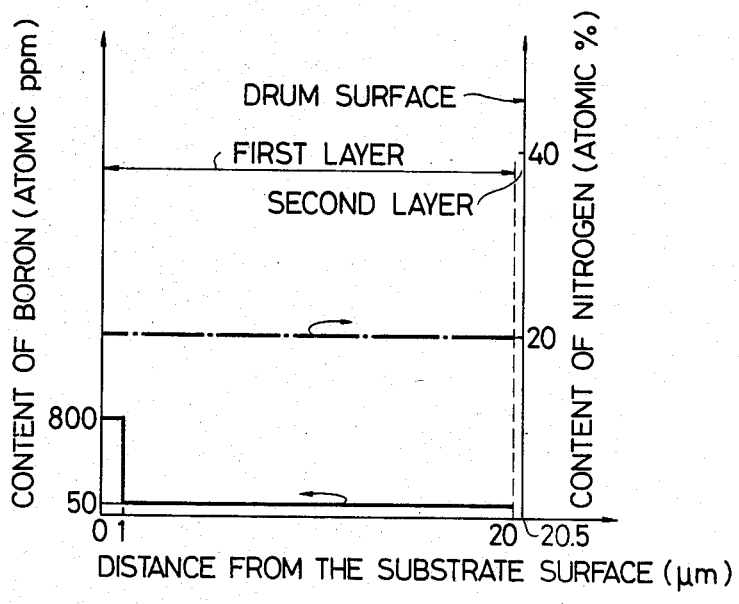
Figure 16:
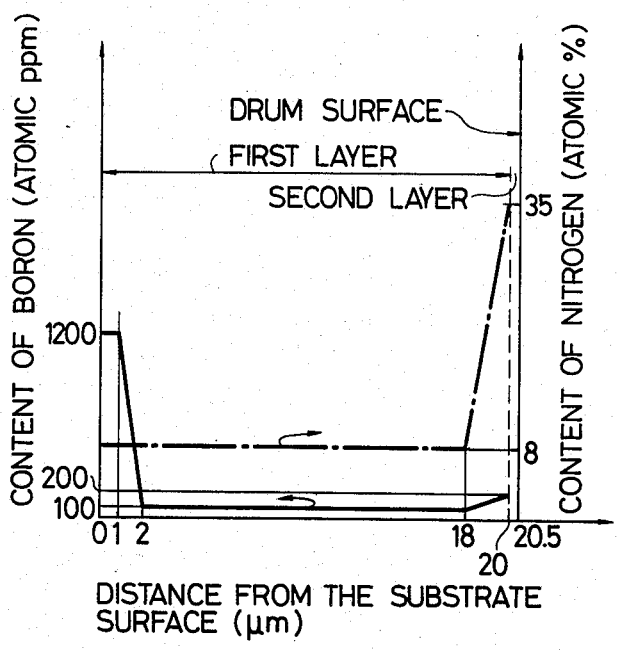
Figure 17:
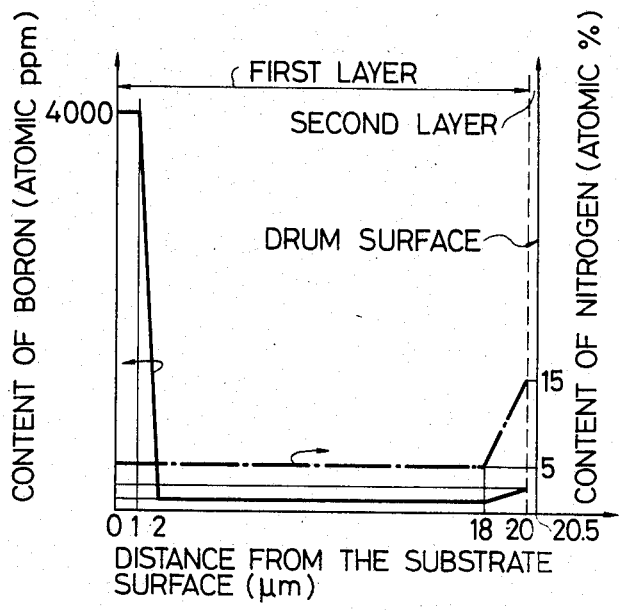
Figure 18:
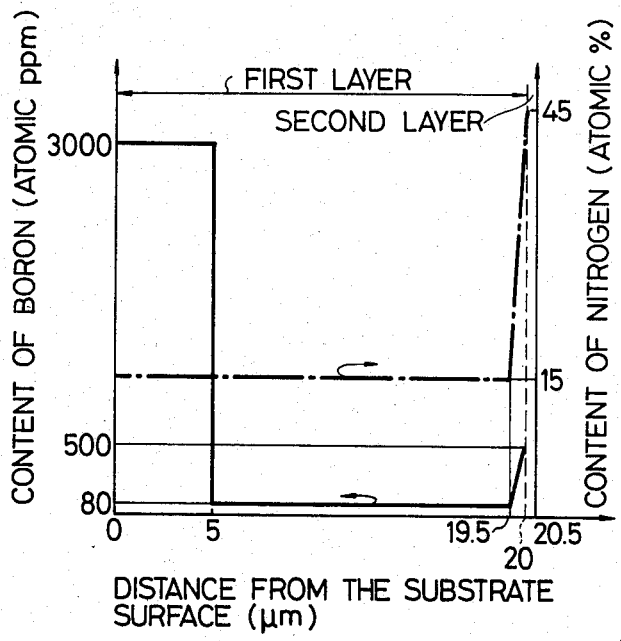

Drum-shaped light receiving members were prepared according to the same procedure as in Example 19 except that the depth profiles of nitrogen atoms and boron atoms were changed as shown in FIG. 15 (Comparative Example 11) and FIG. 16–FIG. 18 (Examples 21–23). Image evaluations were practiced for these light receiving members similarly as in Example 19. As the result, for the drum-shaped light receiving member in Comparative Example 8, the images under ordinary environment were found to be good, but image flow occurred after about 120,000 sheets of copying under high temperature and high humidity conditions. On other hand, for the drum-shaped light receiving members of Examples 21–23, very excellent contrasted images could be obtained and no image flow occurred even under high temperature and high humidity conditions.

EXAMPLE 24

On the light receiving members, of which first layers were formed following the same conditions and the procedures as described in Examples 19, 20 and 21, second layers were formed according to the sputtering method as described in detail in Japanese Laid-open Patent Publication Nos. 52178/1982 and 52179/1982 under the conditions as indicated in Table 18-1, respectively, to prepare 9 kinds of samples, and also 15 kinds of samples were prepared by forming second layers on the same drum-shaped light receiving members as mentioned above according to the same glow discharge method as described in Example 19 except for changing the respective conditions as indicated in Table 18-2 (24 samples as total of 6-1-1 to 6-1-8, 6-2-1 to 6-2-8 and 6-3-1 to 6-3-8).

Each of the image forming members for electrophotography was set individually in a copying device, subjected to corona charging at ⊕5.0 KV for 0.2 sec., followed by irradiation of a light image. As the light source, a tungsten lamp was used as a dosage of 1.0 lux.sec. The latent image was developed with a positively charged developer (containing toner and carrier) and transferred onto conventional paper. The transferred image was very good. The toner remaining on the image forming member for electrophotography was cleaned with a rubber blade. Even when such steps were repeated for 100,000 times or more, no image deterioration was observed in any case.

The results of overall image evaluation of the transferred image and evaluation of durability by successive continuous usage are given in Table 19.

EXAMPLE 25

Image forming members were formed according to entirely the same procedure as in Example 19, except that during formation of the second layer according to the sputtering method, the ratio of silicon atoms to carbon atoms in the second layer was changed by varying the target area ratio of silicon wafer to graphite. For each of the image members thus formed, the same steps of image formation, developing and cleaning as in Example 19 were repeated for 100,000 times, and thereafter image evaluation was conducted to obtain the results as shown in Table 20.

EXAMPLE 26

Image forming members were formed according to entirely the same procedure as in Example 19, except that during formation of the second layer, the ratio of silicon atoms to carbon atoms in the second layer was changed by varying the flow rate ratio of $SiH_4$ gas to $C_2H_4$ gas. For each of the image members thus formed, the same steps of image formation, developing and cleaning as in Example 19 were repeated 100,000 times, and thereafter image evaluation was conducted to obtain the results as shown in Table 21.

EXAMPLE 27

Image forming members were formed according to entirely the same procedure as in Example 19, except that during formation of the second layer, the ratio of silicon atoms to carbon atoms in the second layer was changed by varying the flow rate ratio of $SiH_4$ gas, $SiF_4$ gas and $C_2H_4$ gas (Sample No. A 901–908). For each of the image members thus formed, the same steps of image formation, developing and cleaning as in Example 19 were repeated 100,000 times, and thereafter image evaluation was conducted to obtain the results as shown in Table 22.

TABLE 1

| Lamination order (Region name) | | Gases employed and their flow rates (SCCM) | Gas Pressure (Torr) | Discharging power (W) | Deposition time (min.) |
|---|---|---|---|---|---|
| Lower Layer | 1 (Layer region A) | $SiH_4$: 300<br>$B_2H_6/H_2$*: 450<br>NO: 10.2 | 0.5 | 150 | 6 |
| | 2 (Layer region B) | $SiH_4$: 300<br>$B_2H_6/H_2$*: 3 | 0.25 | 150 | 150 |
| 3 (Upper layer) | | $SiH_4$: 300<br>$B_2H_6/H_2$*: 60<br>$NH_3$: 0 → 45 | 0.22 | 50 | 20 |

*Gas diluted to 1000 ppm (volume) $B_2H_6$ concentration with $H_2$

TABLE 2

| Example No. or Comparative Example No. | Comparative Example 1 | Example 2 | Example 1 | Example 3 | Comparative Example 2 |
|---|---|---|---|---|---|
| Deposition time (min.) | 2 sec | 6 sec | 20 min | 100 min | 250 min |
| Layer thickness | 10 Å | 30 Å | 5000 Å | 3 μm | 7.5 μm |
| Image Evaluation | Δ (1) | ○ | ○ | ○ | Δ (2) |

TABLE 2-continued

○ : Extremely good
Δ (1): After successive copying for 5,000 times, image slightly unfocused under the environment of high temperature (35° C.) and high humidity (90%)
Δ (2): Ground fogging occurred in image

TABLE 3

| Example No. or Comparative Example No. | Comparative Example 3 | Comparative Example 4 | Example 4 | Example 3 | Example 5 | Comparative Example 5 |
|---|---|---|---|---|---|---|
| Ammonia gas flow rate (SCCM) | 0 → $10^{-4}$ | 0 → $10^{-2}$ | 0 → 1 | 0 → 45 | 0 → 300 | 0 → 3000 |
| Image Evaluation | Δ (3) | Δ (4) | ○ | ○ | ○ | Δ (5) |

○ : Extremely good
Δ (3): Image density slightly thin; after successive copying for 5,000 times, image slightly unfocused under high temperature and high humidity environment; at a great image exposure dosage (1.5 lux · sec), clearness slightly lowered
Δ (4): At a great image exposure dosage (1.5 lux · sec), clearness slightly lowered
Δ (5): Ground fogging occurred in image

TABLE 4

| Lamination order (Region name) | | Gases employed and their flow rates (SCCM) | Gas Pressure (Torr) | Discharging power (W) | Deposition time (min.) |
|---|---|---|---|---|---|
| Lower Layer | 1 (Layer region A) | $SiH_4$: 300<br>$B_2H_6/H_2$*: 450 | 0.5 | 150 | 30 |
| | 2 (Layer region B) | $SiH_4$: 300<br>$B_2H_6/H_2$*: 10 | 0.25 | 150 | 200 |
| 3 (Upper layer) | | $SiH_4$: 300<br>$B_2H_6/H_2$*: 60<br>$NH_3$: 1 → 100 | 0.27 → 0.32 | 150 | 20 |

*Gas diluted to 1000 ppm (volume) $B_2H_6$ concentration with $H_2$

TABLE 5

| Lamination order (Region name) | | Gases employed and their flow rates (SCCM) | Gas Pressure (Torr) | Discharging power (W) | Deposition time (min.) |
|---|---|---|---|---|---|
| Lower layer | 1 (Layer region A) | $SiH_4$: 300<br>$B_2H_6/H_2$*: 900<br>NO: 15 | 0.7 | 100 | 3 |
| | 2 (Layer region B) | $SiH_4$: 300<br>$B_2H_6/H_2$*: 10 | 0.26 | 100 | 170 |
| Upper layer | 3 | $SiH_4$: 300<br>$B_2H_6/H_2$*: 30<br>$NH_3$: 15 | 0.28 | 100 | 10 |
| | 4 | $SiH_4$: 300<br>$B_2H_6/H_2$*: 30<br>$NH_3$: 80 | 0.31 | 100 | 4 |

*Gas diluted to 1000 ppm (volume) $B_2H_6$ concentration with $H_2$

TABLE 6

| Lamination order (Region name) | | | Gases employed and their flow rates (SCCM) | Gas Pressure (Torr) | Discharging power ($W/cm^2$) | Layer thickness (μm) |
|---|---|---|---|---|---|---|
| First layer | Lower layer | 1 (Layer region A) | $SiH_4$: 300<br>$B_2H_6/H_2$*: 450 | 0.5 | 0.18 | 2 |
| | | 2 (Layer region B) | $SiH_4$: 300<br>$B_2H_6/H_2$*: 3 | 0.25 | 0.18 | 17.5 |
| | | 3 | $SiH_4$: 300 | 0.22 | 0.06 | 0.5 |

TABLE 6-continued

| Lamination order (Region name) | Gases employed and their flow rates (SCCM) | Gas Pressure (Torr) | Discharging power ($W/cm^2$) | Layer thickness ($\mu m$) |
|---|---|---|---|---|
| (Upper) layer 4 Second layer | $B_2H_6/H_2$*: 60<br>$NH_3$: 0 → 45<br>$SiH_4$: 100<br>He: 200<br>$CH_4$: 235 | | 0.18 | 0.5 |

*Gas diluted to 1000 ppm (volume) $B_2H_6$ concentration with $H_2$

TABLE 7

| Example No. or Comparative Example No. | Comparative 6 | Example 9 | Example 8 | Example 10 | Comparative Example 7 |
|---|---|---|---|---|---|
| Deposition time | 2 sec | 6 sec | 20 min | 100 min | 350 min |
| Layer thickness | 10 Å | 30 Å | 60000 Å | 3 μm | 10.5 μm |
| Image | Δ (1) | ○ | ○ | ○ | ○ |

TABLE 7-continued

| Example No. or Comparative Example No. | Comparative 6 | Example 9 | Example 8 | Example 10 | Comparative Example 7 |
|---|---|---|---|---|---|
| Evaluation | | | | | |

○: Extremely good

Δ (1): After successive copying for 5,000 times, the member was left to stand under the high temperature (37° C.) and high humidity (90%) environment and thercafter image formation was effected under said environment, whereby image was found to be unfocused.

TABLE 8

| Example No. | Comparative Example 8 | Comparative Example 9 | Example 11 | Example 10 | Example 12 | Comparative Example 10 |
|---|---|---|---|---|---|---|
| Ammonia gas flow rate (SCCM) | 0 → $10^{-4}$ | 0 → $10^{-2}$ | 0 → 1 | 0 → 45 | 0 → 300 | 0 → 3000 |
| Image Evaluation | Δ (2) | Δ (3) | ○ | ○ | ○ | Δ (4) |

○: Extremely good

Δ (2): Image density slightly thin; after successive copying for 5,000 times, image slightly unfocused under high temperature and high humidity environment; at a great image exposure dosage (1.5 lux · sec), clearness slightly lowered Δ (3): At a great image exposure dosage (1.5 lux · sec), clearness slightly lowered Δ (4): Ground fogging occurred in image

TABLE 9

| Lamination order (Region name) | | | Gases employed and their flow rates (SCCM) | Gas Pressure (Torr) | Discharging power ($W/cm^2$) | Layer thickness ($\mu m$) |
|---|---|---|---|---|---|---|
| First layer | Lower layer | 1 (Layer region A) | $SiH_4$: 300<br>$B_2H_6/H_2$*: 450 | 0.5 | 0.18 | 0.3 |
| | | 2 (Layer region B) | $SiH_4$: 300<br>$B_2H_6/H_2$*: 10 | 0.25 | 0.18 | 20.7 |
| | | 3 (Upper layer) | $SiH_4$: 300<br>$B_2H_6/H_2$*: 60<br>$NH_3$: 0 → 100 | 0.27 → 0.32 | 0.18 | 1.2 |
| | | 4 Second layer | $SiH_4$: 100<br>He: 200<br>$CH_4$: 250 | 0.3 | 0.18 | 0.5 |

*Gas diluted to 1000 ppm (volume) $B_2H_6$ concentration with $H_2$

TABLE 10

| Lamination order (Region name) | | | Gases employed and their flow rates (SCCM) | Gas Pressure (Torr) | Discharging power ($W/cm^2$) | Layer thickness ($\mu m$) |
|---|---|---|---|---|---|---|
| First layer | Lower layer | 1 (Layer region A) | $SiH_4$: 300<br>$B_2H_6/H_2$*: 900 | 0.7 | 0.12 | 0.3 |
| | | 2 (Layer region B) | $SiH_4$: 300<br>$B_2H_6/H_2$*: 10 | 0.26 | 0.12 | 14 |
| | Upper layer | 3 | $SiH_4$: 300<br>$B_2H_6/H_2$*: 30<br>$NH_3$: 15 | 0.28 | 0.12 | 1 |
| | | 4 | $SiH_4$: 300<br>$B_2H_6/H_2$*: 30<br>$NH_3$: 80 | 0.31 | 0.12 | 0.5 |
| | | 5 Second layer | $SiH_4$: 100<br>He: 200 | 0.3 | 0.18 | 0.5 |

TABLE 10-continued

| Lamination order (Region name) | Gases employed and their flow rates (SCCM) | Gas Pressure (Torr) | Discharging power ($W/cm^2$) | Layer thickness (μm) |
|---|---|---|---|---|
| | $CH_4$: 250 | | | |

*Gas diluted to 1000 ppm (volume) $B_2H_6$ concentration with $H_2$

TABLE 11-1

| Condition | Si wafer:graphite (area ratio) | Discharging power ($W/cm^2$) | Layer thickness (μm) |
|---|---|---|---|
| 8-1 | 1.5:8.5 | 0.3 | 0.5 |
| 8-2 | 0.5:9.5 | 0.3 | 0.3 |
| 8-3 | 6:4 | 0.3 | 1.0 |

During sputtering, Ar was supplied at 200 SCCM.

TABLE 11-2

| Condition | Gases employed and their flow rates (SCCM) | Discharging power ($W/cm^2$) | Layer thickness (μm) |
|---|---|---|---|
| 8-4 | $SiH_4$/He*1: 30<br>$CH_4$: 360 | 0.18 | 0.1 |
| 8-5 | $SiH_4$/He*2: 150<br>$CH_4$: 100 | 0.18 | 0.3 |
| 8-6 | $SiH_4$/He*2: 225<br>$SiF_4$/He*: 225<br>$CH_4$: 350 | 0.18 | 0.5 |
| 8-7 | $SiH_4$/He*2: 34<br>$SiF_4$/He*: 11<br>$CH_4$: 1080 | 0.18 | 0.3 |
| 8-8 | $SiH_4$/He*2: 225<br>$SiF_4$/He*: 225<br>$CH_4$: 100 | 0.18 | 1.5 |

*1 $SiH_4$/He = 1
*2 $SiH_4$/He = 0.5
*$SiF_4$/He = 0.5

TABLE 12

| Preparation conditions for second layer | Sample No./Evaluation | | |
|---|---|---|---|
| 8-1 | 8-1-1<br>○ ○ | 8-6-1<br>○ ○ | 8-7-1<br>○ ○ |
| 8-2 | 8-1-2<br>○ ○ | 8-6-2<br>○ ○ | 8-7-2<br>○ ○ |

TABLE 12-continued

| | | | |
|---|---|---|---|
| 8-3 | 8-1-3<br>○ ○ | 8-6-3<br>○ ○ | 8-7-3<br>○ ○ |
| 8-4 | 8-1-4<br>◎ ◎ | 8-6-4<br>◎ ◎ | 8-7-4<br>◎ ◎ |
| 8-5 | 8-1-5<br>◎ ◎ | 8-6-5<br>◎ ◎ | 8-7-5<br>◎ ◎ |
| 8-6 | 8-1-6<br>◎ ◎ | 8-6-6<br>◎ ◎ | 8-7-6<br>◎ ◎ |
| 8-7 | 8-1-7<br>○ ○ | 8-6-7<br>○ ○ | 8-7-7<br>○ ○ |
| 8-8 | 8-1-8<br>○ ○ | 8-6-8<br>○ ○ | 8-7-8<br>○ ○ |
| | Sample No. | | |
| | Overall image evaluation | Durability evaluation | |

Evaluation standard: ◎ . . . Excellent
○ . . . Good

TABLE 13

| Sample No. | 901 | 902 | 903 | 904 | 905 | 906 | 907 |
|---|---|---|---|---|---|---|---|
| Si:C target (area ratio) | 9:1 | 6.5:3.5 | 4:6 | 2:8 | 1:9 | 0.5:9.5 | 0.2:9.8 |
| Si:C (content ratio) | 9.7:0.3 | 8.8:1.2 | 7.3:2.7 | 4.8:5.2 | 3:7 | 2:8 | 0.8:9.2 |
| Image evaluation | ○ | ○ | ◎ | ◎ | ○ | Δ | X |

◎: Very good
○ : Good
Δ: Practically satisfactory
X: Image defect formed

TABLE 14

| Sample No. | 1001 | 1002 | 1003 | 1004 | 1005 | 1006 | 1007 | 1008 |
|---|---|---|---|---|---|---|---|---|
| $SiH_4$:$C_2H_4$ (Flow rate ratio) | 9:1 | 6:4 | 4:6 | 2:8 | 1:9 | 0.5:9.5 | 0.35:9.65 | 0.2:9.8 |
| Si:C (content ratio) | 9:1 | 7:3 | 5.5:4.5 | 4:6 | 3:7 | 2:8 | 1.2:8.8 | 0.8:9.2 |
| Image evaluation | ○ | ○ | ◎ | ◎ | ◎ | ○ | Δ | X |

◎: Very good
○ : Good
Δ: Practically satisfactory
X: Image defect formed

TABLE 15

| Sample No. | 1101 | 1102 | 1103 | 1104 | 1105 | 1106 | 1107 | 1108 |
|---|---|---|---|---|---|---|---|---|
| $SiH_4$:$SiF_4$:$C_2H_4$ (Flow rate ratio) | 5:4:1 | 3:3.5:3.5 | 2:2:6 | 1:1:8 | 0.6:0.4:9 | 0.2:0.3:9.5 | 0.2:0.15:9.65 | 0.1:0.1:9.8 |
| Si:C (content ratio) | 9:1 | 7:3 | 5.5:4.5 | 4:6 | 3:7 | 2:8 | 1.2:8.8 | 0.8:9.2 |
| Image | ○ | ○ | ◎ | ◎ | ◎ | ○ | Δ | X |

TABLE 15-continued

| Sample No. | 1101 | 1102 | 1103 | 1104 | 1105 | 1106 | 1107 | 1108 |
|---|---|---|---|---|---|---|---|---|
| evaluation | | | | | | | | |

: Very good
: Good
Δ: Practically satisfactory
X: Image defect formed

TABLE 16

| Layer constitution | First layer | Second layer |
|---|---|---|
| Gases employed and their flow rates (SCCM) | $SiH_4$: 500<br>$B_2H_6$: 0.6 → 0.03 → 0.25<br>$NH_3$: 18 → 45 | $SiH_4$: 100<br>He: 200<br>$CH_4$: 235 |
| Discharging power ($W/cm^2$) | 0.18 | 0.18 |
| Layer forming speed (Å/sec) | 19 | 10 |
| Layer thickness (μm) | 20 | 0.5 |
| Pressure during the reaction (torr) | 0.35 | 0.3 |
| Substrate temperature (°C.) | 250 | 200 |
| Discharging frequency (MHz) | 13.56 | 13.56 |

TABLE 17

| Layer constitution | First layer | Second layer |
|---|---|---|
| Gases employed and their flow rates (SCCM) | $SiH_4$: 300<br>$B_2H_6$: 0.9 → 0.025 → 0.06<br>$NH_3$: 15 → 70<br>$H_2$: 900 | $SiH_4$: 100<br>He: 200<br>$CH_4$: 235 |
| Discharging power ($W/cm^2$) | 0.18 | 0.18 |
| Layer forming speed (Å/sec) | 15 | 10 |
| Layer thickness (μm) | 20 | 0.5 |
| Pressure during the reaction (torr) | 0.75 | 0.3 |
| Substrate temperature (°C.) | 250 | 200 |
| Discharging frequency (MHz) | 13.56 | 13.56 |

TABLE 18-1

| Condition | Si wafer:graphite (area ratio) | Discharging power ($W/cm^2$) | Layer thickness (μm) |
|---|---|---|---|
| 6-1 | 1.5:8.5 | 0.3 | 0.5 |
| 6-2 | 0.5:9.5 | 0.3 | 0.3 |
| 6-3 | 6:4 | 0.3 | 1.0 |

During sputtering, Ar was supplied at 200 SCCM.

TABLE 18-2

| Condition | Gases employed and their flow rates (SCCM) | Discharging power ($W/cm^2$) | Layer thickness (μm) |
|---|---|---|---|
| 6-4 | $SiH_4/He^{*1}$: 30<br>$CH_4$: 360 | 0.18 | 0.1 |
| 6-5 | $SiH_4/He^{*2}$: 150<br>$CH_4$: 100 | 0.18 | 0.3 |
| 6-6 | $SiH_4/He^{*2}$: 225<br>$SiF_4/He^*$: 225<br>$CH_4$: 350 | 0.18 | 0.5 |
| 6-7 | $SiH_4/He^{*2}$: 34<br>$SiF_4/He^*$: 11 | 0.18 | 0.3 |

TABLE 18-2-continued

| Condition | Gases employed and their flow rates (SCCM) | Discharging power ($W/cm^2$) | Layer thickness (μm) |
|---|---|---|---|
| 6-8 | $CH_4$: 1080<br>$SiH_4/He^{*2}$: 225<br>$SiF_4/He^*$: 225<br>$CH_4$: 100 | 0.18 | 1.5 |

*1 $SiH_4/He = 1$
*2 $SiH_4/He = 0.5$
* $SiF_4/He = 0.5$

TABLE 19

| Preparation conditions for second layer | Sample No./Evaluation | | |
|---|---|---|---|
| 6-1 | 6-1-1<br>○ ○ | 6-2-1<br>○ ○ | 6-3-1<br>○ ○ |
| 6-2 | 6-1-2<br>○ ○ | 6-2-2<br>○ ○ | 6-3-2<br>○ ○ |
| 6-3 | 6-1-3<br>○ ○ | 6-2-3<br>○ ○ | 6-3-3<br>○ ○ |
| 6-4 | 6-1-4<br>○ ◎ | 6-2-4<br>◎ ◎ | 6-3-4<br>◎ ◎ |
| 6-5 | 6-1-5<br>◎ ◎ | 6-2-5<br>◎ ◎ | 6-3-5<br>◎ ◎ |
| 6-6 | 6-1-6<br>◎ ◎ | 6-2-6<br>◎ ◎ | 6-3-6<br>◎ ◎ |
| 6-7 | 6-1-7<br>○ ○ | 6-2-7<br>○ ○ | 6-3-7<br>○ ○ |
| 6-8 | 6-1-8<br>○ ○ | 6-2-8<br>○ ○ | 6-3-8<br>○ ○ |

Sample No.
Overall image evaluation Durability evaluation

Evaluation standard: ◎ . . . Excellent
○ . . . Good

TABLE 20

| Sample No. | 701 | 702 | 703 | 704 | 705 | 706 | 707 |
|---|---|---|---|---|---|---|---|
| Si:C (area ratio) | 9:1 | 6.5:3.5 | 4:6 | 2:8 | 1:9 | 0.5:9.5 | 0.2:9.8 |
| Si:C (content ratio) | 9.7:0.3 | 8.8:1.2 | 7.3:2.7 | 4.8:5.2 | 3:7 | 2:8 | 0.8:9.2 |
| Image evaluation | Δ | ○ | ◎ | ◎ | ○ | Δ | X |

◎: Very good
○: Good
Δ: Practically satisfactory
X: Image defect formed

TABLE 21

| Sample No. | 801 | 802 | 803 | 804 | 805 | 806 | 807 | 808 |
|---|---|---|---|---|---|---|---|---|
| $Si:C_2H_4$ (Flow rate ratio) | 9:1 | 6:4 | 4:6 | 2:8 | 1:9 | 0.5:9.5 | 0.35:9.65 | 0.2:9.8 |
| Si:C (content ratio) | 9:1 | 7:3 | 5.5:4.5 | 4:6 | 3:7 | 2:8 | 1.2:8.8 | 0.8:9.2 |
| Image | ○ | ○ | ◎ | ◎ | ◎ | ○ | Δ | X |

TABLE 21-continued

| Sample No. | 801 | 802 | 803 | 804 | 805 | 806 | 807 | 808 |
|---|---|---|---|---|---|---|---|---|
| evaluation | | | | | | | | |

◎: Very good
○ : Good
Δ: Practically satisfactory
X: Image defect formed

TABLE 22

| Sample No. | A901 | A902 | A903 | A904 | A905 | A906 | A907 | A908 |
|---|---|---|---|---|---|---|---|---|
| $SiH_4$:$SiF_4$:$C_2H_4$ (Flow rate ratio) | 5:4:1 | 3:3.5:3.5 | 2:2:6 | 1:1:8 | 0.6:0.4:9 | 0.2:0.3:9.5 | 0.2:0.15:9.65 | 0.1:0.1:9.8 |
| Si:C (content ratio) | 9:1 | 7:3 | 5.5:4.5 | 4:6 | 3:7 | 2:8 | 1.2:8.8 | 0.8:9.2 |
| Image evaluation | Δ | ○ | ◎ | ◎ | ◎ | ○ | Δ | X |

◎: Very good
○ : Good
Δ: Practically satisfactory
X: Image defect formed

What is claimed is:

1. A light-receiving member having a substrate and a light-receiving layer having photoconductivity containing an amorphous material comprising a matrix of silicon atoms provided on said substrate, said light-receiving layer having, from the said support side with respect to the layer thickness direction of said layer, a first layer region containing atoms of the group III of the periodic table at higher concentration toward the side of the substrate, wherein the first layer region comprises a layer region A and a layer region B successively from the side of the substrate, in which the content of group III atoms in the layer region A is 30 to $5\times10^4$ atomic ppm, and the thickness of the layer region A is 20 Å to 20μm, and a second layer region containing atoms of the group III of the periodic table and nitrogen atoms, wherein the content of group III atoms in the second layer region is 0.01 to $1\times10^4$ atomic ppm and the thickness of the second layer region is 20 Å to 15μm.

2. A light-receiving member according to claim 1, wherein the light-receiving layer has a third layer region containing silicon atoms and carbon atoms as essential components provided on the second layer region.

3. A light-receiving member according to claim 1, wherein the depth profile of nitrogen atoms in the layer thickness direction has an increasing portion toward the free surface side of the light receiving layer.

4. A light-receiving member according to claim 1, wherein the depth profile of the group III atoms of the periodic table has an increasing portion toward the free surface side of the light receiving layer.

5. A light-receiving layer according to claim 1, wherein the depth profile of nitrogen atoms in the layer thickness direction has an increasing portion toward the support side.

6. A light-receiving layer according to claim 1, wherein the depth profile of the group III atoms of the periodic table has an increasing portion toward the support side.

7. A light-receiving member, having a substrate, a first layer having photoconductivity containing an amorphous material comprising silicon and a second layer containing silicon atoms and carbon atoms as the essential components provided on said first layer, said first layer containing at least one kind of atoms selected from the group III of the periodic table and nitrogen atoms, with the nitrogen atoms having a distributed concentration such that it is increased from a minimum at least at the central portion of the first layer to a maximum at least at the second layer with respect to the layer thickness direction, the distributed concentration of nitrogen atoms contained in the first layer is 0.1 to 57 atomic % at the maximum distributed concentration portion, while it is 0.005 to 35 atomic % at the minimum distributed concentration portion, wherein the maximum distribution concentration is 1.05 times or more relative to the minimum distributed concentration, and the group III atoms of the periodic table having a distributed concentration such that it has the maximum concentration at the end face on the side on which said substrate is provided or the vicinity thereof with respect to the layer thickness direction and the maximum concentration range of the group III atoms in the first layer is 80 to $1\times10^5$ atomic ppm.

8. A light-receiving member according to claim 1, wherein the concentration of the group III atoms contained in the layer region B is lower than the concentration of the group III atoms in the layer region A.

9. A light-receiving member according to claim 3, wherein the depth profile of nitrogen atoms has a concentration of 0.1 to 57 atomic % at the maximum portion and a concentration of 0 to 35 atomic % at the minimum portion.

10. A light-receiving member according to claim 5, wherein the depth profile of nitrogen atoms has concentration of 0.1 to 57 atomic % at the maximum portion and concentration of 0 to 35 atomic % at the minimum portion.

11. A light-receiving member according to claim 2, wherein the third layer region further contains at least one of hydrogen atoms and halogen atoms.

12. A light-receiving member according to claim 7, wherein the second layer further claims at least one of hydrogen atoms and halogen atoms.

13. A light-receiving member according to claim 7, wherein the distributed concentration of the group III atoms has a minimum value of 1 to 1000 atomic ppm at the central portion of the first layer.

14. A light-receiving member according to claim 13, wherein the maximum distributed concentration is 2 times or more relative to the minimum distributed concentration.

15. A light-receiving member according to claim 7, wherein the second layer has a thickness of 0.003 to 30μm.

* * * * *

UNITED STATES PATENT AND TRADEMARK OFFICE

CERTIFICATE OF CORRECTION

PATENT NO. : 4,637,972

DATED : January 20, 1987

INVENTOR(S) : KYOSUKE OGAWA, ET AL.

It is certified that error appears in the above-identified patent and that said Letters Patent is hereby corrected as shown below:

IN THE DRAWINGS, SHEET 10 OF 12

FIG. 13, "SUBSTRACT" should read --SUBSTRATE--.

COLUMN 1

Line 7, "BACKGROUND OF THE INVENTION" should be centered and spacings should be inserted.
Line 16, "solid state" should read --solid-state--.
Line 24, "solid state" should read --solid-state--.
Line 38, "photoelectricconverting" should read photoelectric-converting--.
Line 56, "so called" should read --so-called--.

COLUMN 2

Line 37, "laterial" should read --lateral--.
Line 53, "solid stage" should read --solid-state--.
Line 57, "so" should read --so- --.

COLUMN 4

Line 37, "contained" should read --are contained--.
Line 48, "is" should read --are--.
Line 58, "$3 \times 10^3$" should read --$3 \times 10^2$--.
Line 65, "20 Å A to" should read --20 Å to--.

UNITED STATES PATENT AND TRADEMARK OFFICE

CERTIFICATE OF CORRECTION

PATENT NO. : 4,637,972

DATED : January 20, 1987

INVENTOR(S) : KYOSUKE OGAWA, ET AL.

It is certified that error appears in the above-identified patent and that said Letters Patent is hereby corrected as shown below:

COLUMN 5

Line 27, "bundary" should read --boundary--.
Line 38, "half tone" should read --halftone--.

COLUMN 7

Line 56, "so called" should read --so-called--.

COLUMN 8

Line 27, "ion plating" should read --ion-plating--.
Line 30, "ion" should read --ion- --.
Line 38, "ion plating" should read --ion-plating--.
Line 59, "so" should read --so- --.

COLUMN 9

Line 35, "ion plating" should read --ion-plating--.

COLUMN 10

Line 47, "$SiBr_4$," should read --$SiBr_4$;--.
Line 53, "like," should read --like;--.

COLUMN 11

Line 4, "a-$(Si_xC_{1-x})(H,X)_{1-y}$." should read --a-$(Si_xC_{1-x})_y(H,X)_{1-y}$.--.
Line 15, "sputter" should read --sputtering--.
Line 29, "so called" should read --so-called--.

UNITED STATES PATENT AND TRADEMARK OFFICE

CERTIFICATE OF CORRECTION

PATENT NO. : 4,637,972

DATED : January 20, 1987

INVENTOR(S) : KYOSUKE OGAWA, ET AL.

It is certified that error appears in the above-identified patent and that said Letters Patent is hereby corrected as shown below:

COLUMN 12

Line 4, "400°C, should read --400°C.,--.
Line 11, "In" should read --In a--.

COLUMN 14

Line 40, "5T" should read --FIG. 5T--.

COLUMN 16

Line 60, "preperation" should read --preparation--.

COLUMN 18

Line 13, "3,4" should read --3 - 5--.
Line 48, "⊖6" should read --⊕6--.

COLUMN 19

Line 15, "first layer" should read --light receiving member--.
Line 67, "8-71" should read --8-7-1--.

COLUMN 20

Line 3, "⊕ 5.0" should read --⊖ 5.0--.
Line 5, "as" should read --at--.

COLUMN 21

Line 2, "⊖ 6" should read --⊕ 6--.

UNITED STATES PATENT AND TRADEMARK OFFICE

CERTIFICATE OF CORRECTION

PATENT NO. : 4,637,972

DATED : January 20, 1987

INVENTOR(S) : KYOSUKE OGAWA, ET AL.

It is certified that error appears in the above-identified patent and that said Letters Patent is hereby corrected as shown below:

COLUMN 22

Line 3, "other" should read --the other--.
Line 28, "⊕ 5.0" should read --⊖ 5.0--.
Line 30, "as" should read --at--.

COLUMNS 25 & 26

TBL 7, "Compara-" should read -- Com- --.
tive 6 — parative Example 6

TBL 7, "60Å00" should read --6000 Å--.

TBL 7, Line 9, "thercafter" should read --thereafter--.

COLUMN 26

TBL 8, "Example 12 / 0 →300" should read --Example 12 / 0 →300--.

COLUMN 29

TBL 15, " :Very good" should read -- ◎:Very good--.
:Good — O:Good

COLUMN 30

TBL 19, "6-2-2" should read --6-2-2---

UNITED STATES PATENT AND TRADEMARK OFFICE

CERTIFICATE OF CORRECTION

PATENT NO. : 4,637,972

DATED : January 20, 1987

INVENTOR(S) : KYOSUKE OGAWA, ET AL.

It is certified that error appears in the above-identified patent and that said Letters Patent is hereby corrected as shown below:

COLUMN 30

TBL 19, "6-1-4" should read --6-1-4--.

TBL 19, "Evaluation standard: ◎" should read
...Excellent o
...Good

--Evaluation standard: ◎...Excellent--.
o...Good

COLUMN 32

Line 48, "has" should read --has a--.
Line 50, "and " should read --and a--.
Line 56, "claims" should read --contains--.

Signed and Sealed this

Eleventh Day of August, 1987

*Attest:*

DONALD J. QUIGG

*Attesting Officer* *Commissioner of Patents and Trademarks*